US005996538A

United States Patent [19]

Rocha et al.

[11] Patent Number: 5,996,538

[45] Date of Patent: Dec. 7, 1999

[54] TWO-CYCLE INTERNAL COMBUSTION ENGINE AND METHOD OF OPERATION

[76] Inventors: Octavio Rocha, Condominio La Diana, Monte Capitolio 233-12, Col. Fuentes del Valle; Serafin Cano, Via Asinaria No. 315 otc, Col. Fuentes Del Valle, both of Garza Garcia, N.L. C.P. 66220, Mexico

[21] Appl. No.: 09/089,773

[22] Filed: Jun. 3, 1998

[51] Int. Cl.[6] ..... F02B 53/00

[52] U.S. Cl. ..... 123/18 A; 123/51 BD

[58] Field of Search ..... 123/18 A, 51 BD

[56] References Cited

U.S. PATENT DOCUMENTS

| | | | |
|---|---|---|---|
| 1,094,794 | 4/1914 | Kemper et al. . | |
| 2,233,499 | 3/1941 | Todd et al. | 123/51 BD |
| 3,080,856 | 3/1963 | Berry | 123/18 |
| 3,385,272 | 5/1968 | Winogrodzki et al. | 123/18 |
| 3,580,228 | 5/1971 | Rocha et al. | 123/18 |
| 3,602,203 | 8/1971 | Mowry | 123/18 A |
| 3,666,063 | 5/1972 | Schoeman et al. | 192/21 |
| 4,237,831 | 12/1980 | Noguchi et al. | 123/51 BD |
| 4,799,868 | 1/1989 | Wilson | 418/36 |
| 4,870,869 | 10/1989 | Nagatani | 74/52 |
| 5,029,559 | 7/1991 | Lively, Sr. | 123/51 BD |
| 5,199,391 | 4/1993 | Kovalenko | 123/43 B |
| 5,289,802 | 3/1994 | Pacquette et al. | 123/18 A |
| 5,740,765 | 4/1998 | Ball et al. | 123/18 A |

FOREIGN PATENT DOCUMENTS

| | | |
|---|---|---|
| 2520804 | 8/1983 | France . |
| 2845845 | 4/1980 | Germany . |

*Primary Examiner*—Noah Kamen
*Attorney, Agent, or Firm*—Jenkens & Gilchrist

[57] ABSTRACT

Two pairs of double-acting pistons are disposed in a hollow toroidal structure. Each pair of the double-acting pistons is operatively connected together and moves in the same rotational direction. Each of the pistons has two heads which cooperate with a head of an adjacently disposed piston to define a cylinder therebetween. Near the closest approach of two opposed heads, the fuel-air mixture is burned and the pistons recede from each other on an expansion stroke. Near their farthest separation, one of the opposed heads of the defined cylinder first opens an exhaust port and then the other one of the opposed heads opens an intake port. On a return compression stroke, during which the opposed heads move toward each other, the exhaust port is closed first and the intake port last.

14 Claims, 20 Drawing Sheets

TWO-CYCLE INTERNAL COMBUSTION ENGINE AND METHOD OF OPERATION

BACKGROUND OF THE INVENTION

1. Technical Field

This invention relates generally to a two-cycle internal combustion engine and method of operation, and more particularly to a two-cycle internal combustion engine having a pair of opposed double-acting piston heads partially defining each cylinder of the engine, and to a method for operating such an engine.

2. History of Related Art

Two-cycle engines generally produce from 50% to 80% greater power output per unit piston displacement at the same speed (depending on scavenging), twice as many power impulses per cylinder per revolution, low-cost for valveless designs, and light weight, as compared with conventional four-cycle engines. The advantages of two-cycle engines are applicable to both spark ignition and compression ignition engines.

An example of a two-cycle internal combustion engine having a plurality of double-acting, circularly oscillating pistons disposed in an annular, or toroidal, structure is described in U.S. Pat. No. 3,580,228 titled, "OSCILLATING INTERNAL COMBUSTION ENGINE", issued May 25, 1971 to Octavio Rocha and Serafin Cano, the co-inventors of the present invention. In that patent, the circularly oscillating pistons of the engine were mechanically controlled so that an opposed set of pistons moved toward and away from a fixed point in a respective cylinder, at equal synchronized rates of travel, so that each piston of the opposed set was always simultaneously displaced the same distance from the fixed point in the cylinder.

Also, in the above-referenced two-cycle engine arrangement, the exhaust ports were opened first during an expansion stroke, but closed last during a compression stroke. This characteristic is common to all valveless two-cycle engines wherein the port that opens first during one stroke, closes last during a return stroke. This action precludes effective charging and/or supercharging of the engine to increase the amount of charge per cycle above that of a normally scavenged and charged cylinder. The better a cylinder is charged with air or combustible mixture, the higher the power developed.

Furthermore, in conventional two-cycle engines, such as the above-described circularly oscillating piston engine, it is commonly accepted that combustion occurs instantly when the piston or pistons are at top dead center, i.e., when the gas volume is at a minimum. In actual practice, the minimum gas volume is typically maintained over only a very short time after ignition occurs, after which the combustion event continues during the expansion, or power, stroke which generally results in the higher hydrocarbon emissions typical of two-cycle engines. Hydrocarbon emissions are produced because the flame of combustion cannot completely reach the walls of the cylinder, thus leaving a layer of unburned fuel on the wall and discharging unburned fuel, together with the products of combustion, through the exhaust port of the engine. The flame front is cooled by the cool walls of the cylinder as it approaches the walls, flame speed decreases as the flame front temperature drops, and finally the flame stops. Accordingly, the lower the temperature and pressure of the combustion process, the thicker the unburned layer and the higher the exhaust hydrocarbon emissions. Lean fuel-air mixtures are commonly used to reduce hydrocarbon emissions. However, as the fuel-air ratio is reduced, the flame speed decreases and finally becomes so slow that the combustion process is not completed during the expansion stroke. Therefore, when the minimum volume in the cylinder is maintained over only a very short period of time, the use of lean fuel-air mixtures is restricted.

Another common characteristic of conventional two-stroke engines is uneven cycle pressure peaks between the cylinders of the engine, and even in the same cylinder from stroke to stroke. This characteristic reduces overall engine efficiency, and makes it difficult to produce consistent power output for a given fuel charge.

The present invention is directed to overcoming the problems set forth above. It is desirable to have a two-cycle internal combustion engine that has a relatively long combustion period during which minimum volume conditions are maintained in the combustion chamber so that after ignition, the combustion process starts, and since the minimum volume is maintained and combustion progresses, the pressure greatly increases, whereby lower emissions of hydrocarbons are produced and fuel economy is increased as a result of more efficient combustion during engine operation. It is also desirable to have a two-cycle internal combustion engine in which a pair of opposed piston heads associated with each cylinder are moved at different rates of travel to provide a relatively long minimum volume time and relatively long scavenging times during engine operation. Furthermore, it is desirable to have a valveless two-cycle internal combustion engine in which the exhaust ports open first during an expansion stroke and close first during a compression stroke, thereby enabling effective blowdown, scavenging, charging, and if desired, supercharging at appropriately beneficial times during the operating cycles of the engine. It is also desirable to have a two-cycle engine in which successive cycle pressure peaks evenly, between all cylinders and from stroke to stroke, are substantially uniform for equal fuel charges.

SUMMARY OF THE INVENTION

In accordance with one aspect of the present invention, a two-cycle internal combustion engine has first and second pairs of double-headed pistons arranged in a hollow toroidal structure so that an exhaust port controlling head of each of the first pair of pistons is disposed in opposed relationship with an intake port controlling head of one of the second pair of pistons, and an intake port controlling head of each of one of the first pair of pistons is disposed in opposed relationship with an exhaust port controlling head of one of the second pair of pistons. Each of the opposed heads cooperate with preselected portions of the interior surface of the hollow toroidal structure to define respective spaced apart cylinders, each having an intake port and an exhaust port in fluid communication with each defined cylinder. Each of the defined cylinders has a variable volume which is increased by movement of the opposed heads away from each other during an expansion stroke and is decreased by the movement of the opposed heads towards each other during a compression stroke. The intake port controlling heads, each defining a portion of a respective cylinder, opens and closes an associated intake port, and the exhaust port controlling heads, each defining a portion of a respective cylinder, opens and closes an associated exhaust port. Circular oscillatory movement of each of the pistons is controlled so that, in each cylinder, the exhaust port is opened before opening of the intake port during an expansion stroke and the exhaust port is closed before closing of the intake port during a compression stroke.

Other features of the two-cycle internal combustion engine embodying the present invention include each piston having a mid portion disposed between the respective exhaust port controlling and intake port controlling heads of the piston. Each piston is operatively connected at its mid portion to a crankshaft. Other features include the engine having an auxiliary shaft concentrically disposed along a central axis of the hollow toroidal structure, a first hollow shaft oscillatably mounted in concentric relationship with the auxiliary shaft, a second hollow shaft oscillatably mounted in concentric relationship with the first hollow shaft, a first pair of arms respectively connecting the mid portion of each of the first pair of opposed pistons to the first hollow shaft, and a pair of second arms respectively connecting the mid portion of each of the second pair of opposed pistons to the second hollow shaft. The engine also includes a crankshaft having a single direction of rotation and disposed in spaced relationship from the auxiliary shaft, and first and second articulated linkages respectively extending between the first hollow shaft and the crankshaft and the second hollow shaft and the crankshaft.

In another aspect of the present invention, first and second pairs of pistons are arranged in a hollow toroidal structure so that an intake port controlling head of each of the first pair of pistons is disposed in opposed relationship with an exhaust port controlling head of one of the second pair of pistons, and the exhaust port controlling head of each of the first pair of pistons is disposed in opposed relationship with an intake port controlling head of one of the second pair of pistons. Each pair of opposed heads cooperate with preselected portions of the interior surface of the hollow toroidal structure to define a cylinder in which the volume is increased by movement of the opposed heads in respective opposite directions away from each other during an expansion stroke and is decreased by the movement of the opposed heads in respective opposite directions toward each other during a compression stroke. Each of the opposed heads of each cylinder is individually moveable between a respective top dead center position and a respective bottom dead center position within the defined cylinder. Also, both of the opposed heads within a defined cylinder are unidirectionally moveable at positions proximate their respective top dead center position whereby the volume of the cylinder is maintained at a substantially constant minimum value, and simultaneously unidirectionally moveable at a position proximate their respective bottom dead center positions whereby the volume of the cylinder is maintained at a substantially constant maximum value, during respective prolonged periods of each rotation of a crankshaft to which the pistons are operatively connected.

In yet another aspect of the present invention, a two-cycle internal combustion engine has first and second pairs of pistons arranged in a hollow toroidal structure so that an exhaust port controlling head of each of the first pair of pistons is disposed in opposed relationship with the intake port controlling head of one of the second pair of pistons, and the intake port controlling head of each of the first pair of pistons is disposed in opposed relationship with the exhaust port controlling head of one of the second pair of pistons, thereby forming four pairs of opposed heads. Each pair of the opposed heads cooperate with preselected portions of the interior surface of the hollow toroidal structure to define a respective cylinder having an intake port and an exhaust port in fluid communication with the cylinder. Each of the cylinders has a variable volume that is increased by movement of the respective opposed heads away from each other during an expansion stroke of a combustion cycle, and is decreased by movement of the opposed heads toward each other during a compression stroke of a combustion cycle. The intake port controlling head of each cylinder operatively opens and closes the inlet port in fluid communication with the respective cylinder, and the exhaust port controlling head of each cylinder operatively opens and closes the exhaust port in fluid communication with the respective cylinder. The intake port controlling head is moved at a rate faster than the exhaust port controlling head when traveling in the direction of the compression stroke of the combustion cycle, and the exhaust port controlling head is moved at a rate faster than the intake port controlling head during the expansion stroke of the combustion cycle.

In still another aspect of the present invention, a method for operating a two-cycle internal combustion engine having at least one variable volume cylinder with an intake port and an exhaust port in fluid communication with the cylinder and in which an exhaust port controlling head and an intake port controlling head are oscillatably disposed for movement toward and away from each other between respective top dead center and bottom dead center positions within the cylinder, includes moving the intake port controlling and exhaust port controlling heads toward their respective top dead center positions and forming a substantially minimum volume value of said cylinders, and igniting a fuel-air mixture disposed between the intake port controlling and exhaust port controlling heads when the cylinder has the substantially minimum volume value. The method further includes moving the intake port controlling head to its top dead center position, and then away from its top dead center position in a direction toward its bottom dead center position, before moving the exhaust port controlling head to its top dead center position. The exhaust port controlling head is then moved away from its top dead center in a direction toward its bottom dead center position. The method further includes sequentially passing the exhaust port controlling head past the exhaust port and thereby opening the exhaust port while it is moving toward its dead bottom center position and exhausting products of the ignited fuel-air mixture from the cylinder, then passing the intake port controlling head past the intake port and thereby opening the intake port while the intake port controlling head is moving toward its bottom dead center position, moving the exhaust port controlling head to its bottom dead center position, moving the exhaust port controlling head away from its bottom dead center position and in a direction toward its top dead center position, moving the intake port controlling head to its bottom dead center position, and then moving the intake port controlling head in a direction away from its bottom dead center position and in a direction toward its top dead center position. The method then further includes sequentially passing the exhaust port controlling head past the exhaust port and thereby closing the exhaust port while moving the exhaust port controlling head toward its top dead center position and thereby interrupting the flow of air through the cylinder between the intake port and the exhaust port, injecting a combustible fuel through the intake port and into the cylinder, passing the intake port controlling head past the intake port and thereby closing the intake port while moving the intake port controlling head toward its top dead center position, and then compressing a mixture of combustible fuel and air in the cylinder while moving the exhaust port controlling head and the intake port controlling head toward their respective top dead center positions.

Other features of the method for operating a two-cycle internal combustion engine, in accordance with the present invention, include after passing the intake port controlling head, when moving toward its bottom dead center, past the intake port and thereby opening the intake port and after moving the exhaust port controlling head to the bottom dead center position of the exhaust port controlling piston, thereby opening the exhaust port, directing a flow of air through the cylinder between the open intake port and the open exhaust port. Other features include the directing the flow of air through the cylinder by directing a flow of air having a pressure greater than the pressure of the surrounding atmosphere through the cylinder.

Other features of the method for operating a two-cycle internal combustion engine, in accordance with the present invention, include the injecting of a combustible fuel through the intake port and into the cylinder by injecting a mixture of combustible fuel and air through the intake port and into the cylinder.

BRIEF DESCRIPTION OF THE DRAWINGS

A more complete understanding of the engine and method of operating an engine, in accordance with the present invention, may be had by reference to the following detailed description when taken in conjunction with the accompanying drawings, wherein.

DETAILED DESCRIPTION OF PRESENTLY PREFERRED EXEMPLARY EMBODIMENTS

Figure 1:
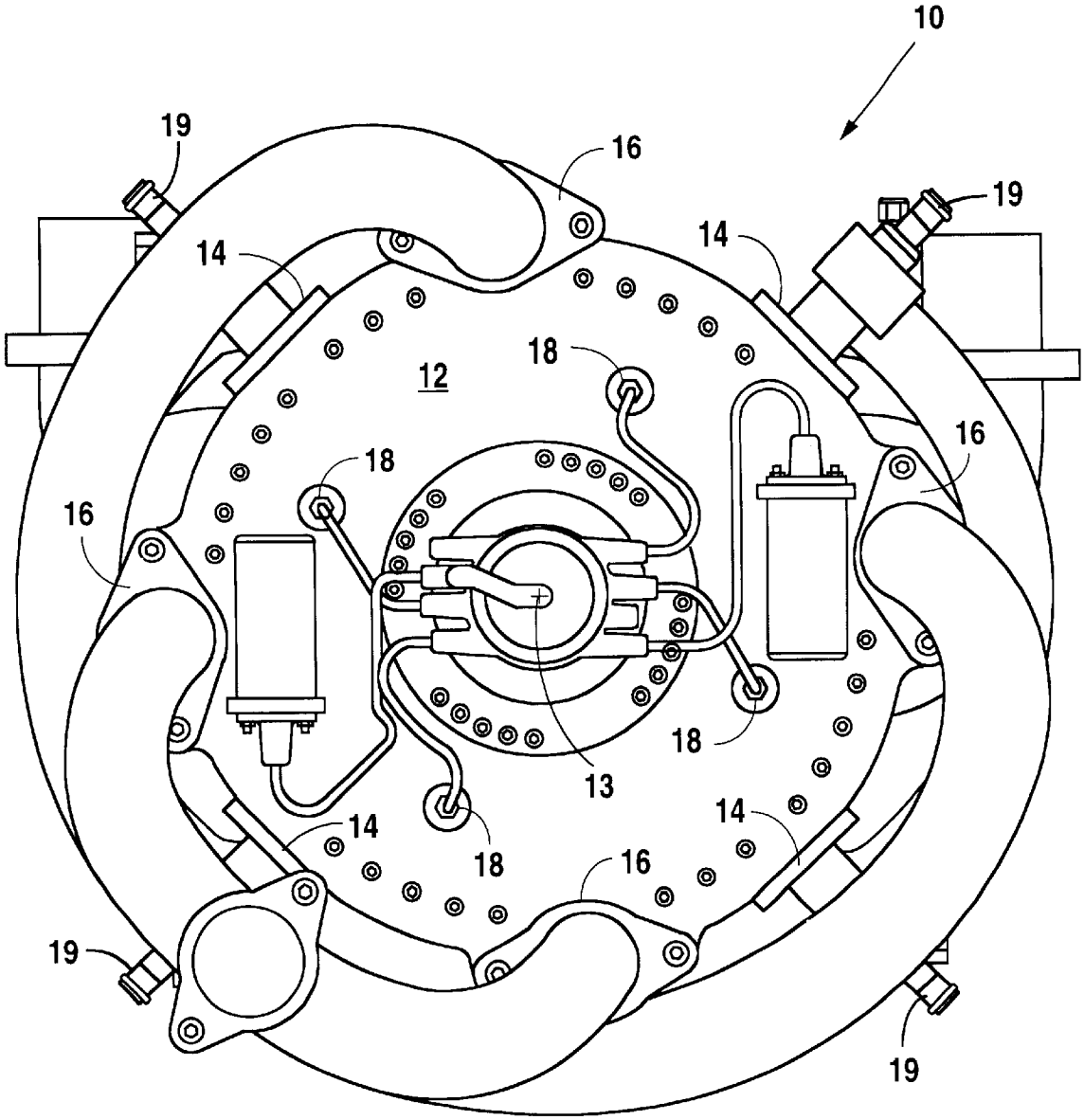
FIG. 1 is a frontal view of an internal combustion engine embodying the present invention.

As shown in FIGS. 1–7, an internal combustion engine 10 embodying the present invention has a hollow toroidal structure 12 radially disposed about a central axis 13. A plurality of intake ports 14 and exhaust ports 16 are defined at circumferentially spaced apart positions around the interior surface of the hollow toroidal structure. The term "toroidal" is used herein in its customary sense as describing a donut-shaped structure. Although such a structure is typically described as being generated by a circle rotated about an axis in its plane that does not intersect the circle, if desired other rotated shapes, such as an ellipse, rectangle or other suitable shape may be employed to form the hollow toroidal structure of the engine embodying the present invention.

A first pair of toric segment-shaped pistons 20, 40 are oscillatably disposed, for movement through a circular arc, in the hollow toroidal structure 12 at radially opposed, spaced apart positions. Each member 20, 40 of the first pair of pistons has a respective intake port controlling head 22, 42, and a respective exhaust port controlling head 24, 44, alternatively referred to herein more simply as the "intake head" and "exhaust head", with the exhaust head 24, 44 of each piston being spaced from the respective intake head 22, 42. A mid portion 26, 46 is disposed between the intake and exhaust heads of the respective pistons 20, 40. A second pair of toric segment-shaped pistons 30, 50 are oscillatably disposed, for movement through a circular arc, in the hollow toroidal structure 12 at radially opposed, spaced apart positions in interposed relationship with the first pair of pistons 20, 40. Each member 30, 50 of the second pair of pistons has a respective intake head 32, 52, a respective exhaust head 34, 54 spaced from the respective intake head 32, 52, and a respective mid portion 36, 56 intermediately positioned between the respective intake and exhaust heads.

Figure 5:
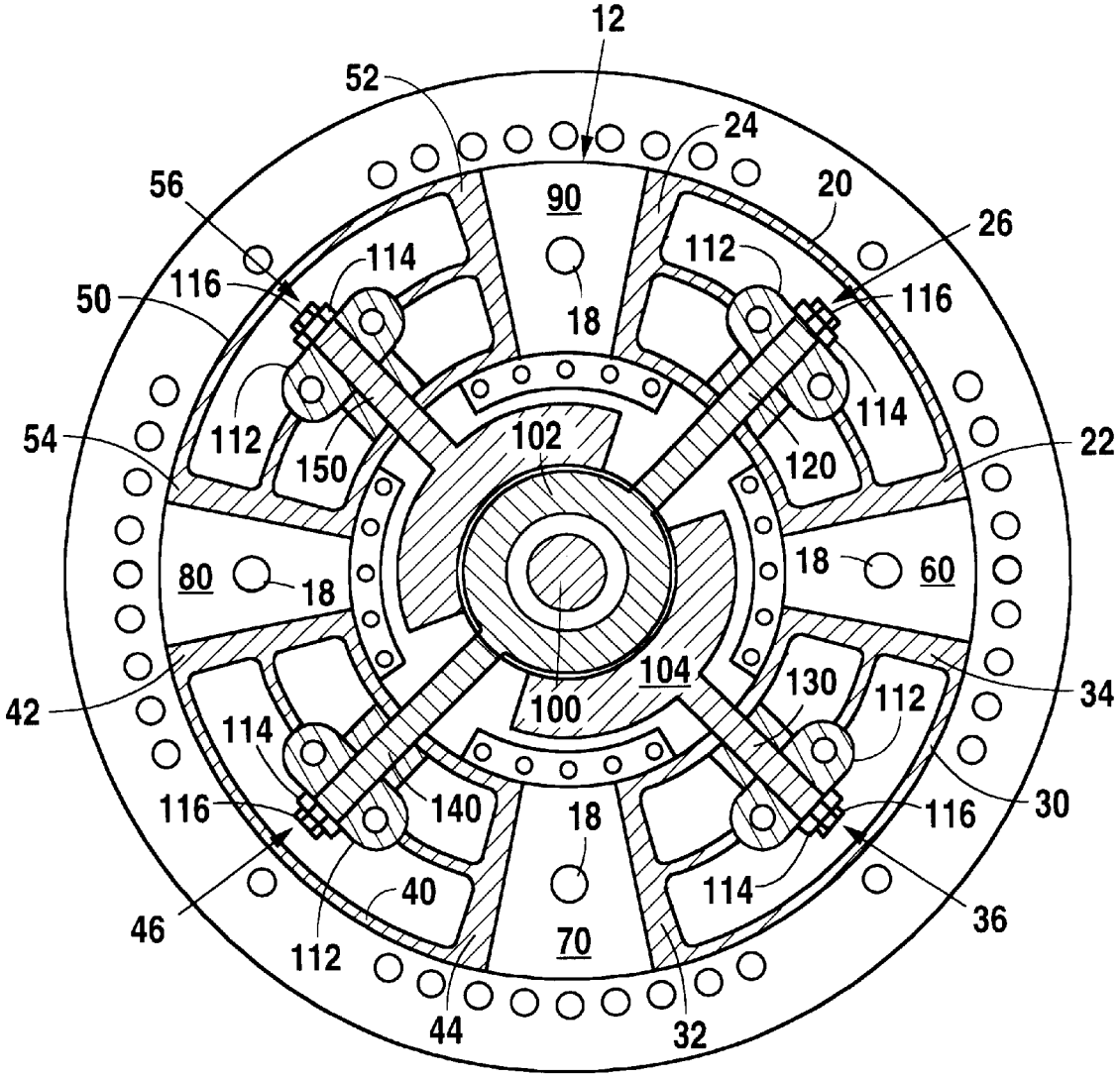
FIG. 5 is a cross-sectional view of the engine embodying the present invention, taken along the line 5—5 of FIG. 4.

The first and second pairs of pistons 20, 40 are arranged in the hollow toroidal structure 12 so that the intake head 22, 42 of each of the first pair of pistons 20, 40 is disposed in opposed relationship with the exhaust head 34, 54 of one of the second pair of pistons 30, 50. Likewise, the exhaust head 24, 44 of each of the first pair of pistons 20, 40 is disposed in opposed relationship with the intake head 32, 52 of one of the second pair of pistons 30, 50. As best shown in FIG. 5, the respective opposed heads of the first and second pair of pistons 20, 40 and 30, 50 form four pair of opposed heads 22–34, 32–44, 42–54, and 52–24, that cooperate with portions of the interior surface of the hollow toroidal structure 12 to define respective spaced apart cylinders 60, 70, 80, 90. Each of the cylinders 60, 70, 80, 90, have one of the intake ports 14 and one of the exhaust ports 16 disposed in fluid communication with the respective cylinder. In the illustrated embodiment, each of the intake ports 14 and exhaust ports 16 are formed by a plurality of circumferentially spaced openings in the interior wall of the hollow toroidal structure 12. Although in the drawings, all ports 14, 16 appear to be of the same size, the areas of the inlet ports 14 is less than that of the exhaust ports 16.

Figure 6:
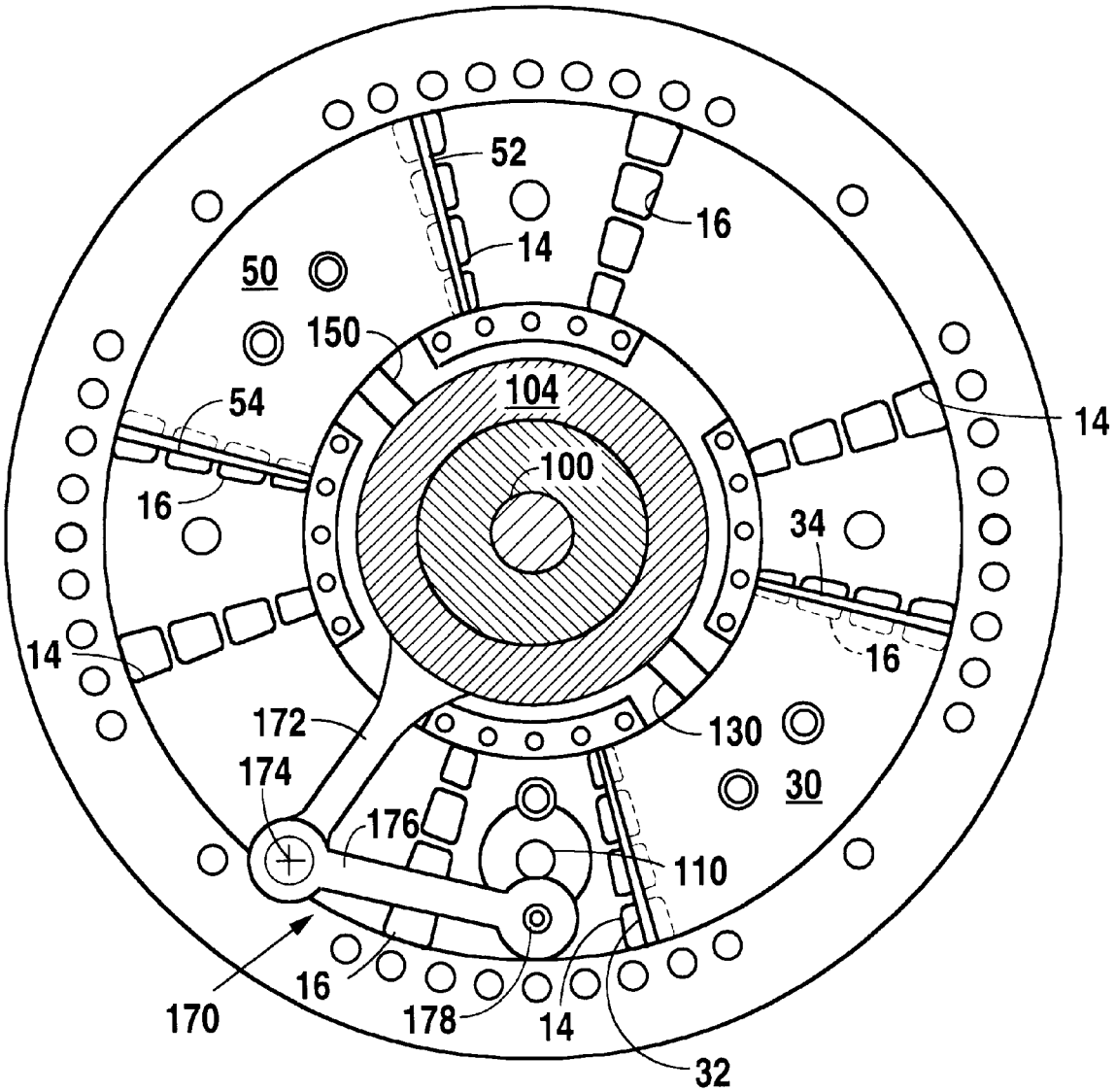
FIG. 6 is a cross-sectional view of the engine embodying the present invention, taken along the line 6—6 of FIG. 4 with the outer housing removed to better show the associated pair of pistons.
Figure 7:
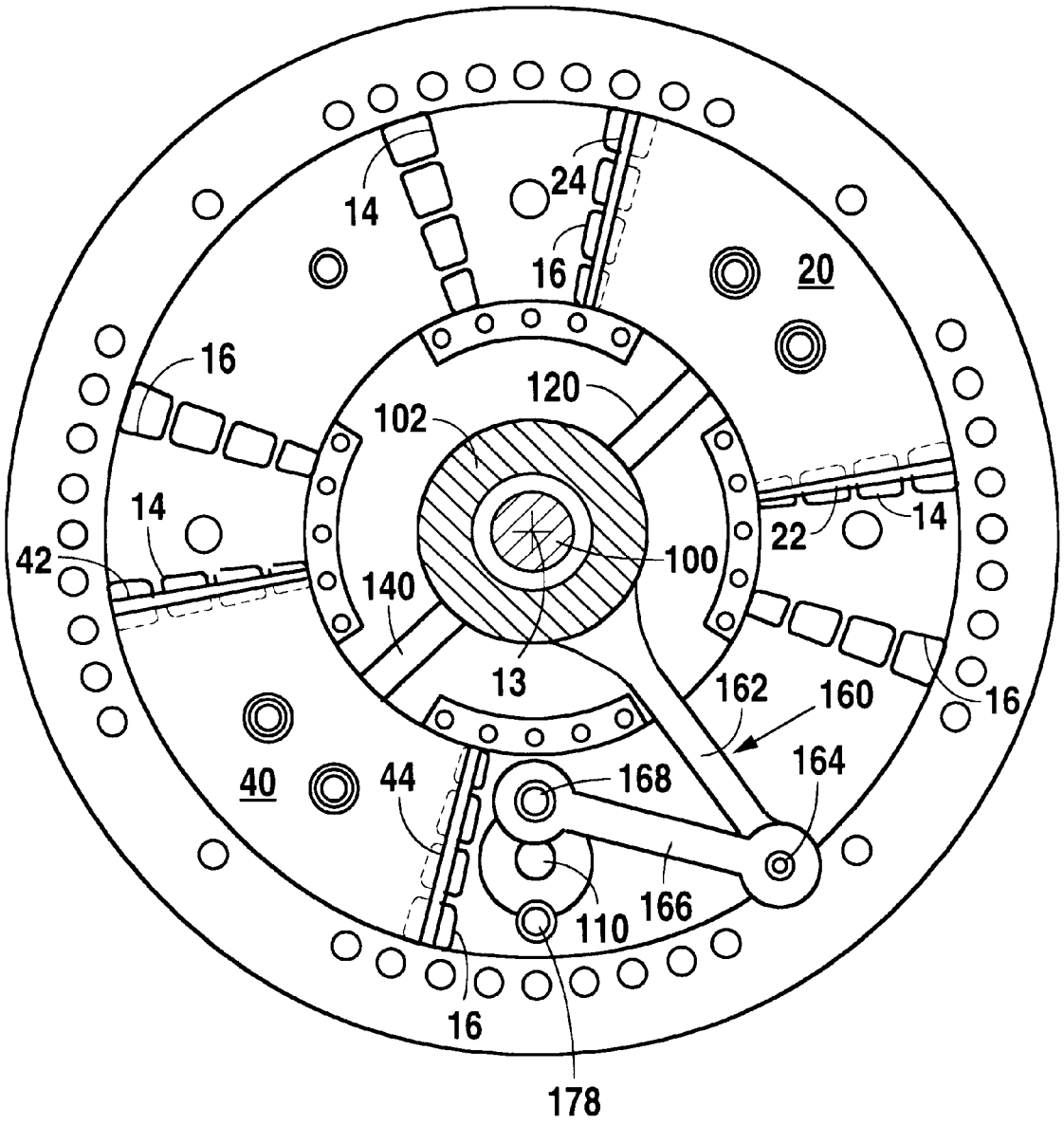
FIG. 7 is a cross-sectional view of the engine embodying the present invention, taken along the line 7—7 of FIG. 4 with the outer housing removed to better show the associated pair of pistons.

Each of the cylinders 60, 70, 80, 90, have a variable volume that is increased by the movement of the opposed heads away from each other during an expansion stroke and is decreased by the movement of the opposed heads toward each other during a compression stroke during circular oscillatory movement of the associated piston 20, 30, 40, 50. As best shown in FIGS. 6 and 7, the intake heads 22, 32, 42, 52 operatively open and close a respective one of the intake ports 14, and the exhaust heads 24, 34, 44, 54 operatively open and close a respective one of the exhaust ports 16, during the circular oscillatory movement of the associated piston 20, 30, 40, 50. Importantly, as described below in greater detail, the circular oscillatory movement of each of the first and second pair of pistons 20, 30, 40, 50 is controlled so that the exhaust port 16 disposed in each of the respective cylinders 60, 70, 80, 90 is opened before opening of the intake port 14 during an expansion stroke, and the exhaust port 16 is closed before closure of the intake port 14 during a compression stroke.

A sparkplug 18 is disposed in each of the cylinders 60, 70, 80, 90 at a position substantially midway between the intake port 14 and the exhaust port 16 that are spaced apart from each other toward opposite ends of the respective cylinder 60, 70, 80, 90. The spark plugs 18 are employed in an engine adapted for spark ignition of a combustible mixture. Alternatively, if the engine is adapted for compression ignition of the combustible fuel-air mixture, a glow plug may be positioned in each of the cylinders 60, 70, 80, 90 at the approximate midpoint of the respective cylinder.

Desirably, the engine 10 includes one, or as shown in the exemplary embodiment, two, crankshaft driven compressors 180 to provide a source of compressed air, i.e., air having a pressure greater than that of the surrounding atmosphere, to provide beneficial scavenging air and, if desired, a source of compressed air for supercharging the cylinder 20, 30, 40, 50 after closure of the exhaust ports 16 and before closure of the intake ports 14.

The central axis 13 passes through the center of an auxiliary shaft 100. As illustrated in FIG. 5, a first pair of rods 120, 140 respectively connect the mid portions 26, 46 of each one of the first pair of pistons 20, 40 to a first hollow shaft 102 that is oscillatably mounted in concentric relationship with respect to the central axis 13 of the hollow toroidal structure 12. A second pair of rods 130, 150 respectively connect the mid portions 36, 56 of each of one of the second pair of pistons 30, 50 to a second hollow shaft 104 that is oscillatably mounted in concentric relationship with the central axis 13 and the first hollow shaft 102. The connection of the respective rods 120, 130, 140, 150 to the respective mid portions 26, 36, 46, 56 of the first and second pair of pistons 20, 30, 40, 50 is secured by a respective piston positioning member 112 disposed at the mid portion of each of the pistons. The radial distance of the respective pistons 120, 130, 140, 150 from the central axis 13 of the hollow toroidal structure 12 is adjustably fixed by an appropriately-sized radial movement limiting stop 114 inserted between the flanged head of a retaining bolt 116 threaded into a threaded end of the respective rod 20, 30, 40, 50. Alternatively, a nut may be threaded onto external threads provided on the end of the respective rod, with an appropriately sized radial movement limiting stop 114 inserted between the nut and the distal end of the respective rod.

The first pair of pistons 20, 40 are thus connected via respective rods 120, 140 to the first hollow shaft 102 which oscillates between clockwise and counterclockwise movement and controls the oscillatory motion of the first pair of pistons 20, 40. As best shown in FIG. 7, the first hollow shaft 102 is connected by a first articulated linkage 160 to a crankshaft 110 that rotates in a unitary, counterclockwise direction and is disposed in spaced relationship from the auxiliary shaft 100 and the first hollow shaft 102. The first articulated linkage 160 includes a control arm 162 rigidly attached to the first hollow shaft 102 and has a distal end pivotally connected to a connecting rod 166 through an intermediate pivot joint 164. The connecting rod 166 is in turn connected at a distal end to the crankshaft 110 by way of a pivot joint 168. In a similar manner, as best shown in FIG. 6, the second hollow shaft 104 is attached to the crankshaft 110 by a second articulated linkage 170. The second articulated linkage 170 includes a control arm 172 rigidly attached to the second hollow shaft 104 and has a distal end connected to a connecting rod 176 by way of an intermediate pivot joint 174. The connecting rod 176 is connected to the crankshaft 110 by a pivot joint 178. Importantly, the first connecting rod 166 and the second connecting rod 176 are equal in length and provide the same distance, through their respective articulated linkages 160, 170, between the center of rotation of the crankshaft 110 and the central axis 13 of the hollow toroidal structure 12.

Figure 9:
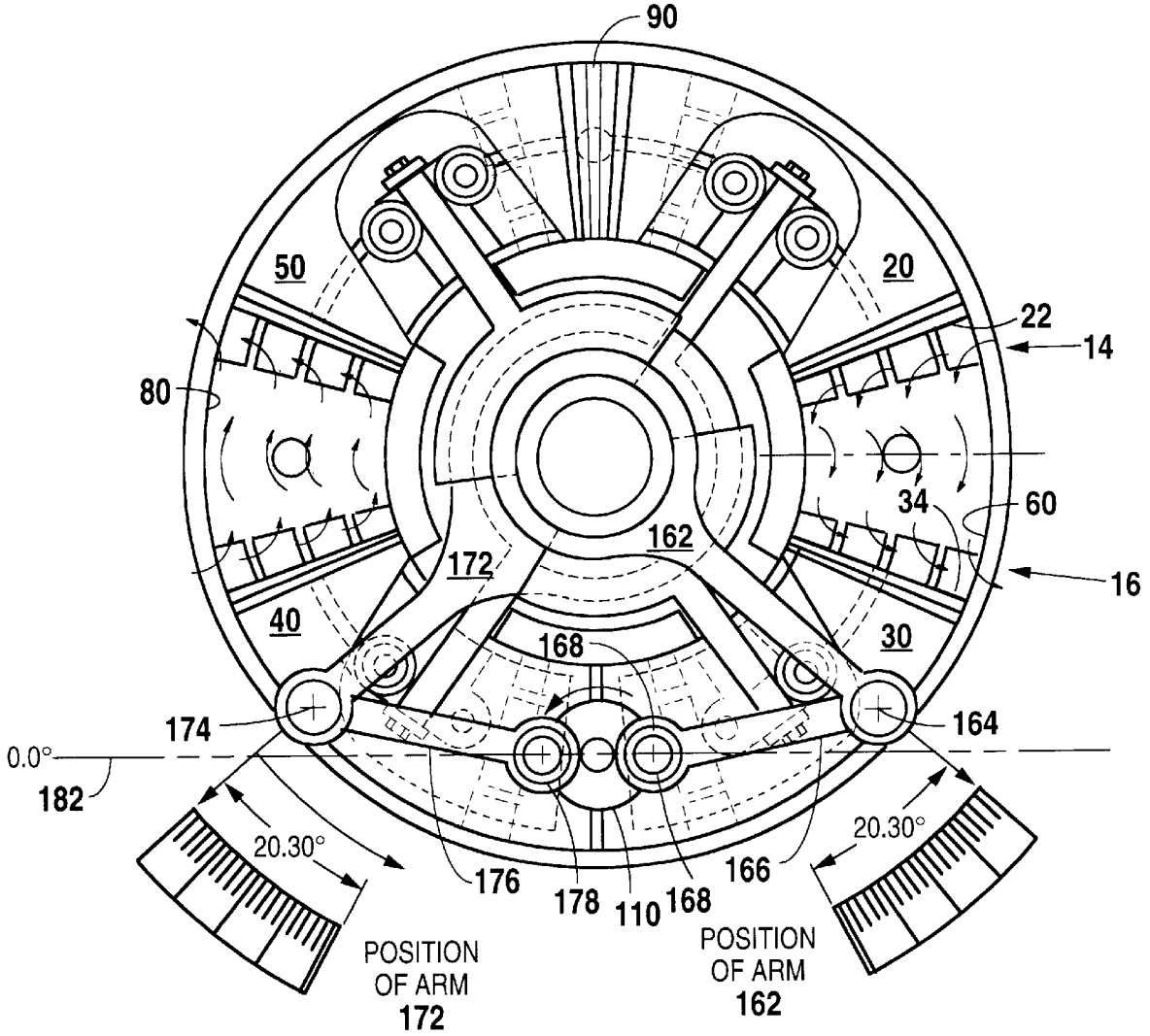
FIG. 9 is a schematic diagram showing the relative position of the two pairs of pistons disposed in a cylinder of the engine embodying the present invention, when the crankshaft is at a zero degree position.
Figure 10:
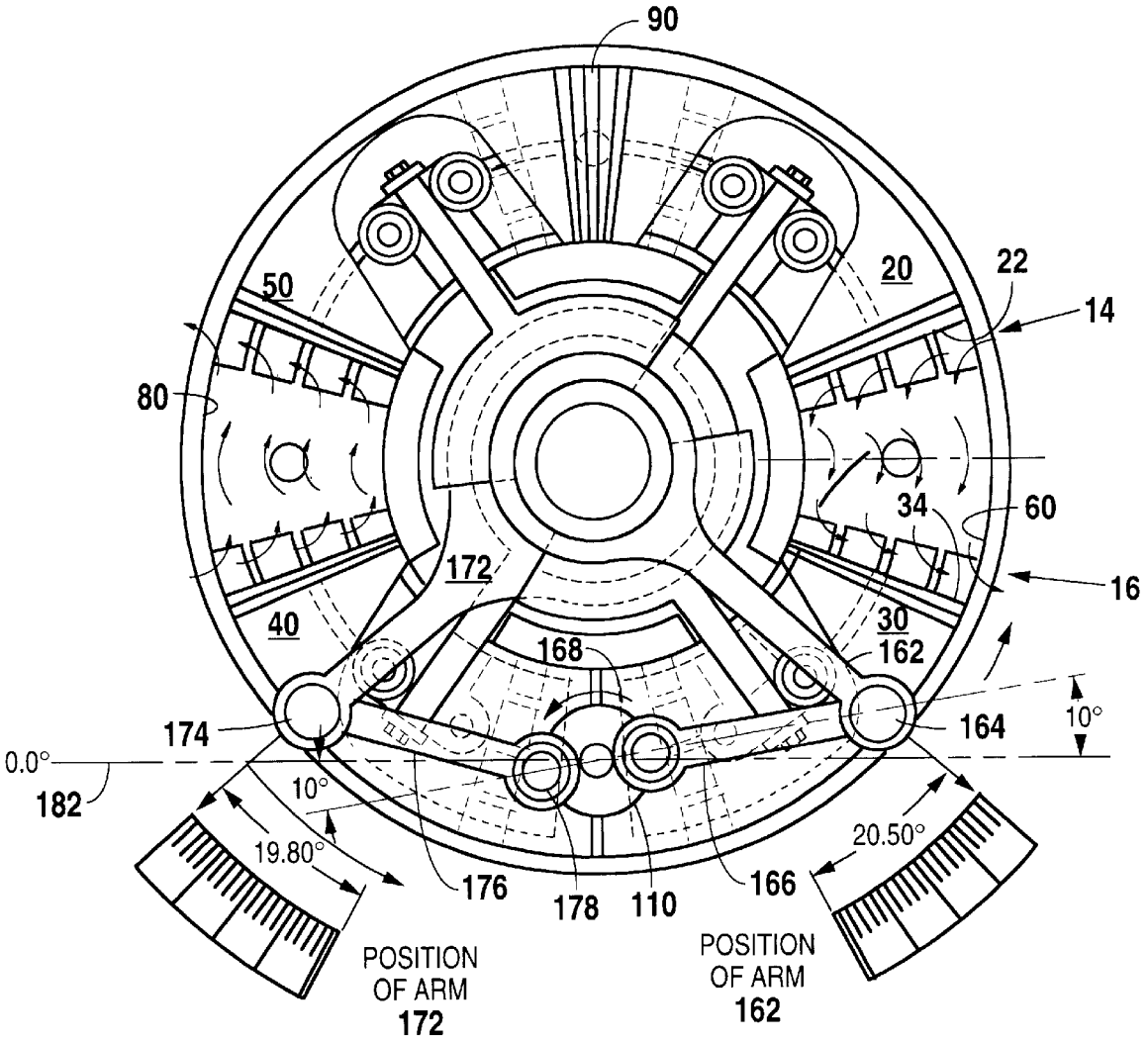
FIG. 10 is a schematic diagram showing the relative position of the two pairs of pistons disposed in a cylinder of the engine embodying the present invention, when the crankshaft is at a 10° counterclockwise rotation position.
Figure 18:
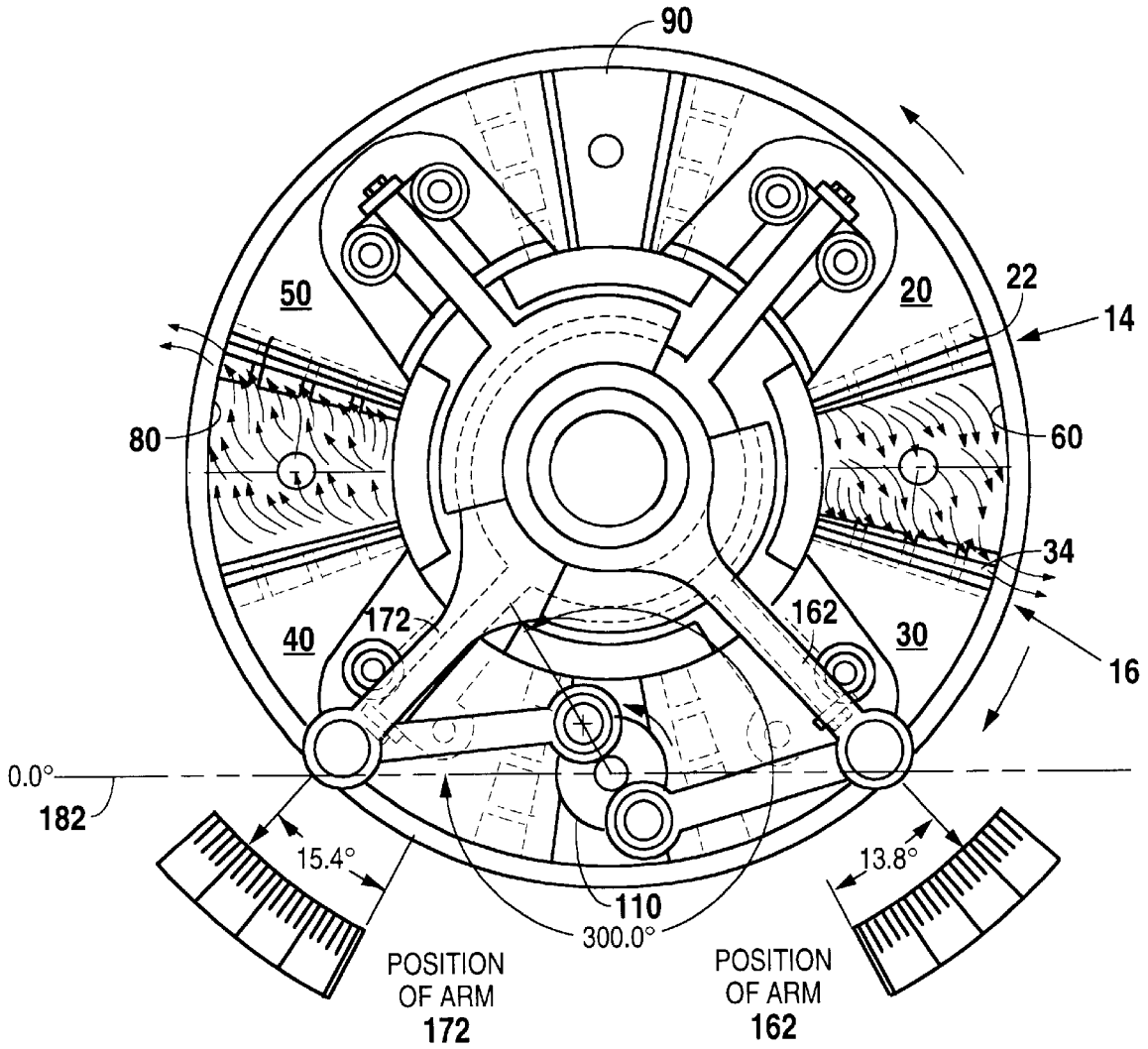
FIG. 18 is a schematic diagram showing the relative position of the two pairs of pistons disposed in a cylinder of the engine embodying the present invention, when the crankshaft is at a 300° counterclockwise rotation position.
Figure 19:
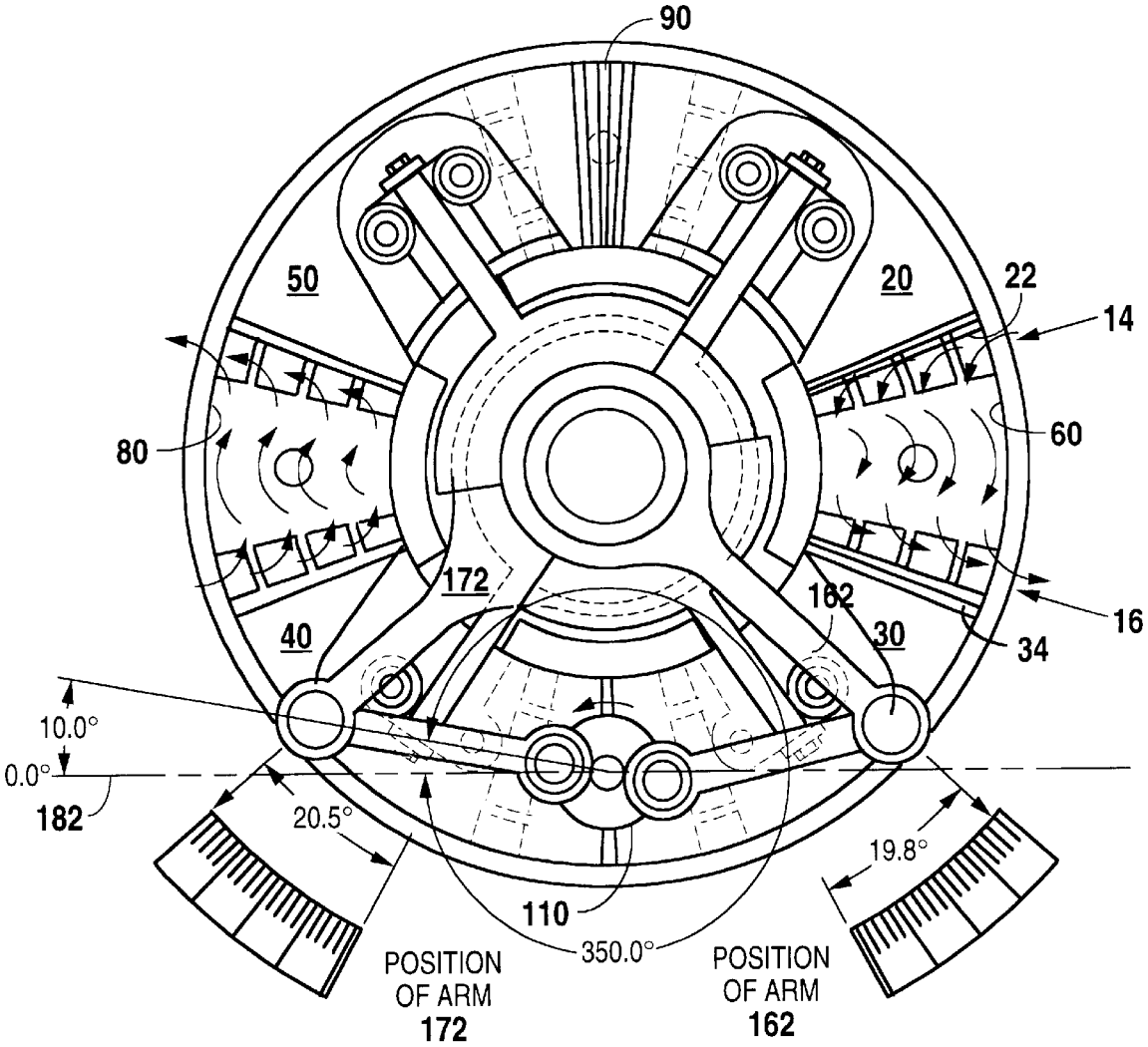
FIG. 19 is a schematic diagram showing the relative position of the two pairs of pistons disposed in a cylinder of the engine embodying the present invention, when the crankshaft is at a 350° counterclockwise rotation position.

Turning now to the graph illustrated in FIG. 8 and the schematic drawings presented in FIGS. 9–19, the operation of the engine 10, through one 360° rotation of the crankshaft 110, is explained in the following description. The 0° (and 360°) position of the crankshaft 110 is defined, as shown in FIG. 9, as the position at which the pivot joints 168, 178 respectively joining the connective rods 166, 176 to the crankshaft 110 are at respective 3 o'clock and 9 o'clock positions, i.e., the centers for the pivot joints 168, 178 lie on a common line 182 identified as the 0° reference line which, in the exemplary embodiment, is perpendicular to a line extending between the center of the crankshaft 110 and the auxiliary shaft 100. The respective intermediate pivot joints 164, 174 are positioned above the 0° reference line. In the illustrated embodiment, the intermediate pivot points 164, 174 are offset from the 0° position 182 by 10°. That is, when the crankshaft 110 is rotated ten degrees counterclockwise past the 0° position, as shown in FIG. 10, the centers of the intermediate pivot joint 164 and the pivot joint 168 are aligned in a common line with the center of the crankshaft 110. At that position, the control arm 162 is moved to its furthermost counterclockwise position. When the crankshaft is moved 170° in a counterclockwise direction, the centers of the pivot joints 164, 168 are again aligned with the center of the crankshaft 110 (see FIG. 14 for approximate position), and the control arm 162 is moved to its furthermost clockwise position. In a similar manner, the centers of the pivot joints 174, 178 of the second articulated linkage are aligned with the center of the crankshaft 110 when the crankshaft 110 is at the 350° counterclockwise position, as shown in FIG. 19, whereat the control arm 172 is moved to its furthermost clockwise position. When the crankshaft 110 is rotated to the 190° position, the centers of the pivot joints 174, 178 are commonly aligned with the center of the crankshaft 110, and the control arm 172 is moved to its furthermost counterclockwise position.

As can be readily understood from a study of the respective angular positions of the crankshaft 110, the rate of movement of the control arms 162, 172 is substantially small for each degree of rotation of the crankshaft when the crankshaft 110 is at the angular position corresponding to the furthermost limits of travel of the respective arms 162, 172. As will be more fully understood after the below-described operation of the engine 10, the respective top dead center (TDC) and bottom dead center (BDC) positions of the heads occur at the extreme limits of motion of the control arms 162, 172, i.e., at respective 10° and 170°, and 190° and 350° rotation positions of the crankshaft 110. Also, because the angular displacement of the respective control arms 162, 172 is very small at the extreme limits of the clockwise and counterclockwise movements, the associated heads also have very small arcuate displacement when in close proximity to their respective TDC and BDC positions. More specifically, the opposed heads move through a respective arc of less than ±0.10° during approximately 6° of crankshaft rotation each side of the respective TDC and BDC positions. Furthermore, the relative movement of the heads with respect to each other is essentially negligible (less than ±1.0°) during 36° of rotation of the crankshaft 110 when proximate their respective TDC and BDC positions. As described below in greater detail, between their respective TDC positions, both heads move in the same direction and have a total arcuate separation change of less than 1° between crankshaft rotation positions of 16° and 198°, thereby providing an almost constant volume (ACV) combustion chamber during 36° of crankshaft rotation. Similarly, an almost constant maximum volume condition is provided proximate the respective BDC zones. The respective TDC, BDC, and ACV zones are identified in the graph of FIG. 8.

This principle will be further illustrated with specific reference to FIGS. 9–19 in which the angular movement position of the control arms 162, 172 move, and accordingly the pistons are shown for varying positions of the crankshaft 110. The stroke of each of the pistons 20, 30, 40, 50 is 20.5°. At their point of closest approach, there is a minimum separation of about 1°. The operation of the engine 10 will be described with respect to the events occurring in a single cylinder during one 360° rotation of the crankshaft 110. For purposes of illustration, the events occurring in cylinder 60, and accordingly simultaneously in cylinder 80, will be referenced. It should be understood that the same events occur in cylinders 70, 90 at 180° later rotation of the crankshaft 110.

The cylinder 60 has an intake head 22 of the piston 20 defining one end of the cylinder, and an exhaust head 34 of the piston 30 defining the opposite boundary of the cylinder 60. An intake port 14 and an exhaust port 16 are disposed at opposite ends of the cylinder 60. With reference to the graph of FIG. 8, the movement of the intake head 22 is represented by the upper line of the graph, with the bottom dead center zone between about 40 and 160 and top dead center zone between about 164° and 176° identified, along with the respective windows during which the inlet port 14 is open (IPO) and closed (IPC). The bottom line 34 represents the position of the exhaust head 34 of the piston 30 with the bottom dead center and top dead center zones, respectively between about 344° and 356°, and between about 184° and 196°, indicated on the graph. Likewise, the windows during which the exhaust port 16 is open (EPO) and closed (EPC) is also represented. As described above, the bottom dead center (BDC) and top dead center (TDC) zones are defined as the rotational angle through which the crankshaft moves during which the movement of the respective pistons produces only a small effect on the volume of the respective cylinder and, accordingly, the cylinder is considered to have an almost constant volume (ACV) throughout the respective TDC and BDC zones. Also, as described below in more detail, the heads 22, 34 move in the same direction, at substantially identical arcuate movement rates between their respective TDCs at 170° and 190°. Unidirectional movement of the heads also occurs between their respective BDC positions at the 350° and 10° rotation angles of the crankshaft 110. Thus, prolonged almost constant minimum and maximum volume conditions are maintained during respective 36° angular rotation zones of the crankshaft 110 during which the difference in distance between the opposed heads is less than about 1°. More specifically, an almost constant minimum volume (ACV) is maintained in the cylinder 60 between about 162° and 198° rotation of the crankshaft 110 and an almost constant maximum volume is maintained in the cylinder 60 between about 342° and 18° rotation of the crankshaft 110.

The position of the respective pistons 20, 30, 40, 50 when the crankshaft 110 is at the 0° position is shown in FIG. 9. At this position, the control arm 172, controlling the position of pistons 30, 50 has already passed its furthermost travel in a clockwise direction, at which the exhaust head 34 was at its BDC position, (350°), and has reversed its travel direction to a clockwise direction so that both the first and second sets of pistons are traveling in the same clockwise direction. Thus, the exhaust head 34 and the intake head 22 of the cylinder 60 are concurrently moving in the same direction at the 0° reference position. The concurrent travel direction will be sustained until the control arm 162 controlling the movement of pistons 20, 40, has reached the furthest limit of its clockwise rotation at the 10° reference position illustrated in FIG. 10, whereat the piston 20 reverses direction and the intake and exhaust heads 22 and 34 begin to move toward each other.

Thus, it can be seen that each set of pistons 20, 40 and 30, 50 attain the same maximum angular distance (20.5°) from the center of the respective cylinder 60, 70, 80, 90, although hot at the same time, i.e., not at the same angle of rotation of the crankshaft 110. At the 0° and 180° crankshaft rotation angle, the pistons 20, 30, 40, 50, are exactly at the same angular distance (20.3°) from the center of the respective cylinder 60, 70, 80, 90. As described above, a few degrees before (342°) until after (18°) the 0° crankshaft rotation angle, the heads 22, 34 are spaced apart by a substantially constant distance, i.e., less than about 1° change in arcuate separation distance, and the cylinder 60 has an almost constant maximum volume during 360 of rotation of the crankshaft 110. Likewise, for about 18° before and after the 180° crankshaft rotation angle, i.e., for about 36°, both sets of pistons remain in almost equal spaced apart relationship with each other.

Figure 2:
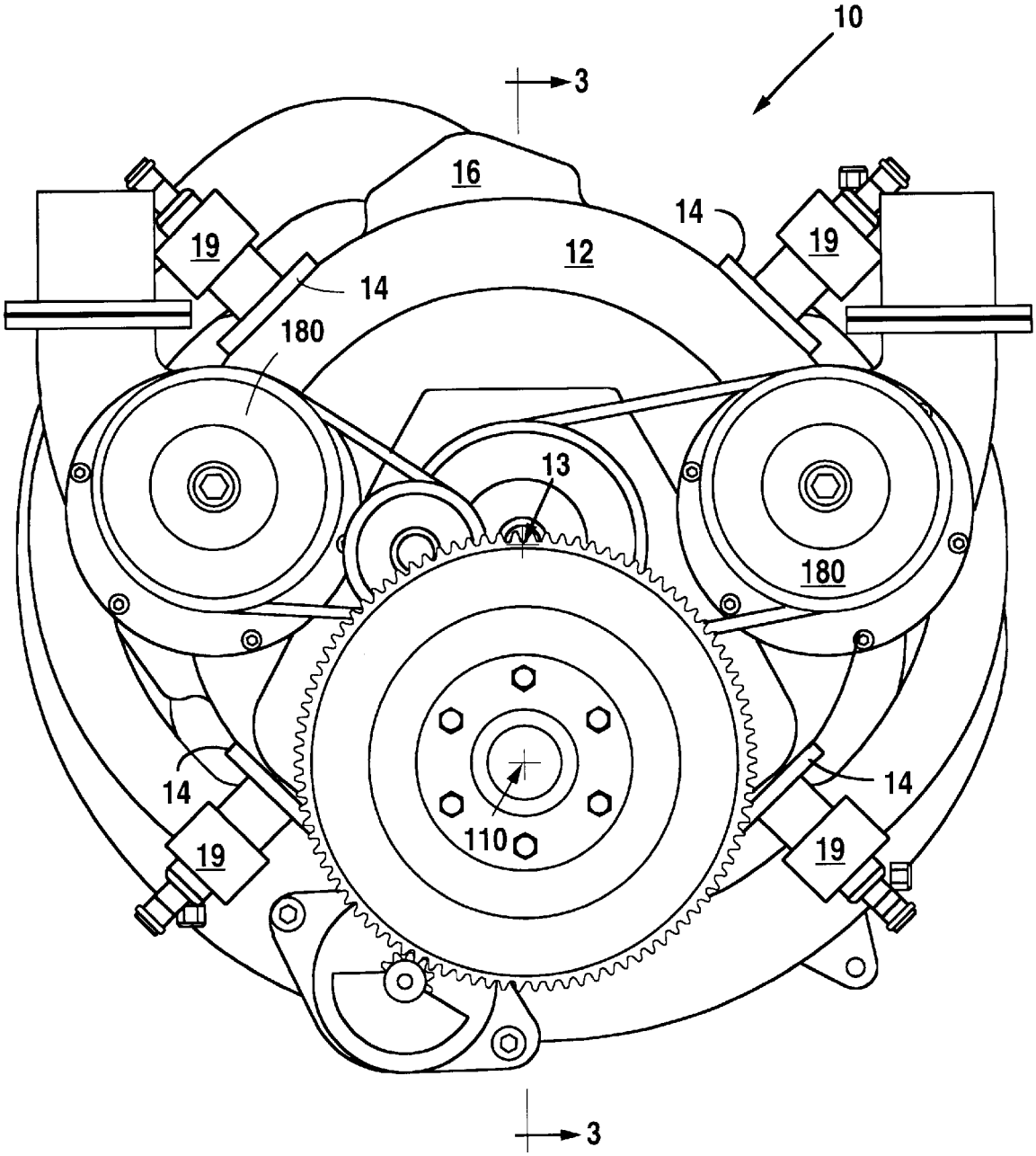
FIG. 2 is a rear view of the internal combustion engine embodying the present invention.
Figure 3:
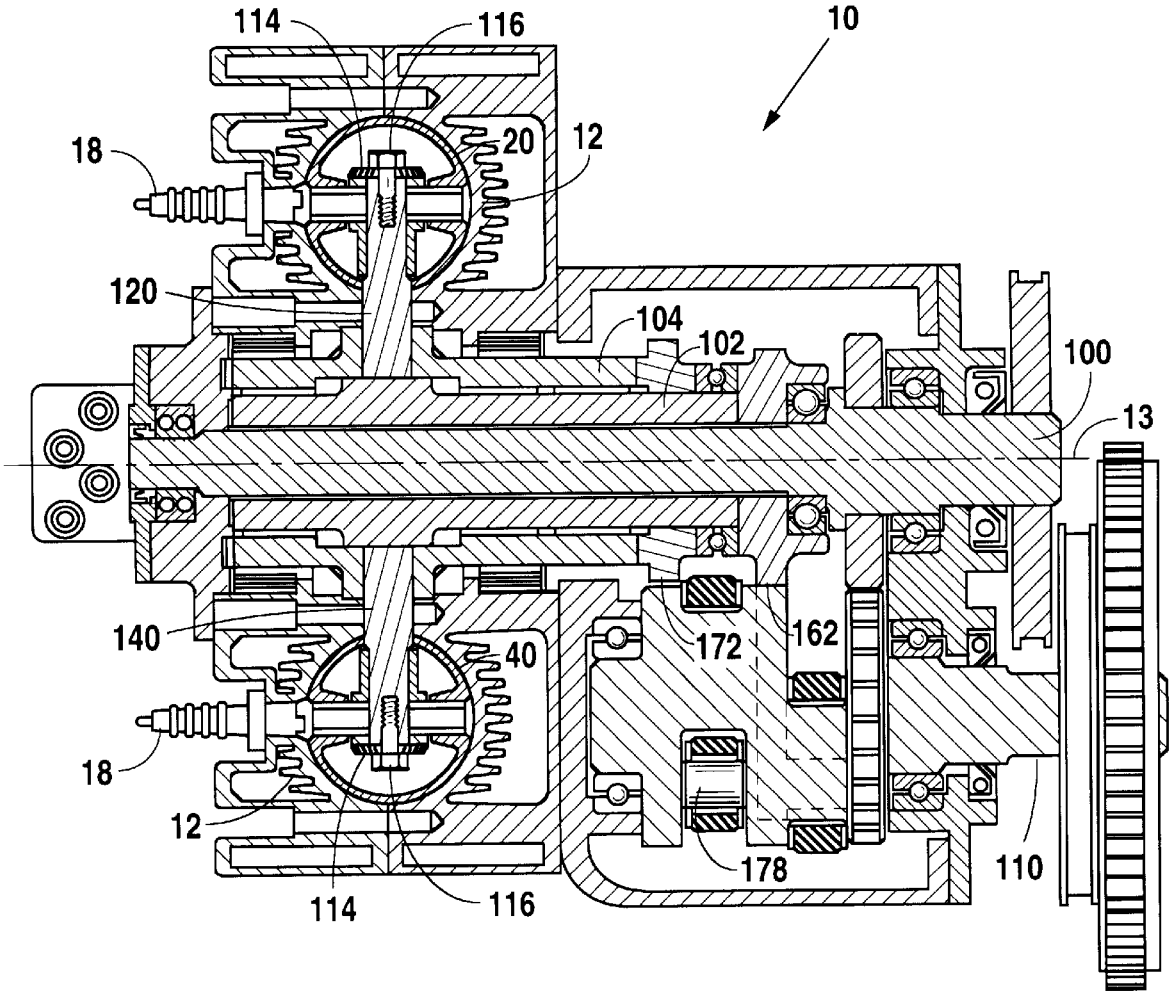
FIG. 3 is a longitudinal sectional view of the engine embodying the present invention, taken along the line 3—3 of FIG. 2 with the pistons rotated about 45° out of position for illustrative purposes.
Figure 4:
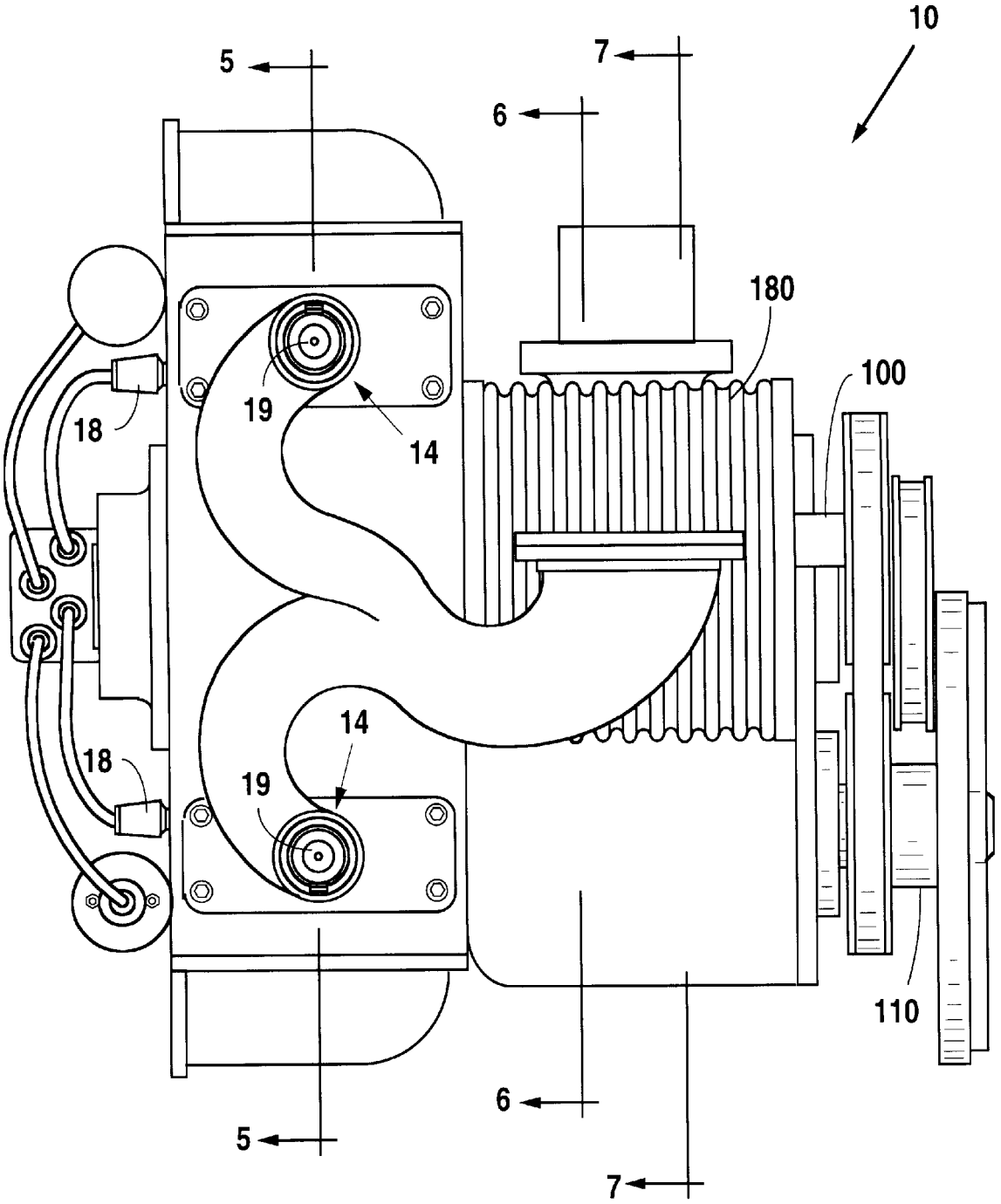
FIG. 4 is a side view of the engine embodying the present invention.

With specific reference again to FIG. 9, at the 0° crankshaft position, the opposed heads 22, 34 are each arcuately spaced 20.3° from the center of the cylinder and both moving in a counterclockwise direction. Since both heads 22, 34 are almost at their maximum distance (20.5°) from the center of the cylinder 60, the intake port 14 and the exhaust port 16 are open, and uniflow scavenging of the cylinder 60 is occurring. Desirably, the uniflow scavenging action is aided by an auxiliary compressor 118. In the exemplary embodiment, as illustrated in FIG. 2, two vane type compressors 118 are driven by the crankshaft 110 of the engine 10 and provide air for scavenging and/or charging or supercharging. Alternatively, if a source of compressed air is not provided, the cylinder will be naturally aspirated during the period of time that both the intake ports 14 and exhaust ports 16 are open.

Figure 11:
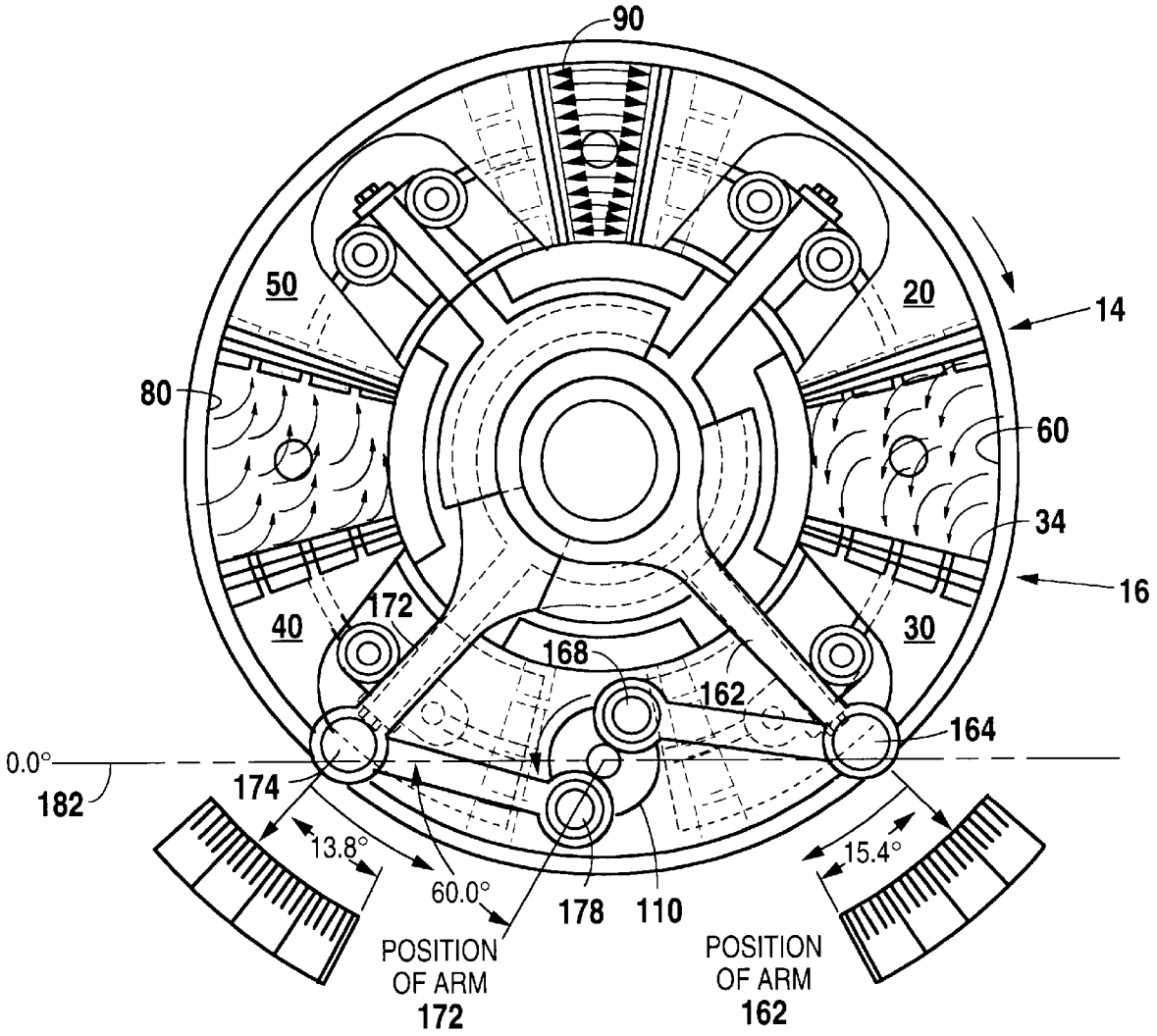
FIG. 11 is a schematic diagram showing the relative position of the two pairs of pistons disposed in a cylinder of the engine embodying the present invention, when the crankshaft is at a 60° counterclockwise rotation position.

At 10° of counterclockwise rotation of the crankshaft 110 as shown in FIG. 11, the piston 20 is at its BDC position whereupon it reverses direction. Scavenging of the cylinder 60 is still taking place, since the intake port 14 and the exhaust port 16 remain open.

Figure 12:
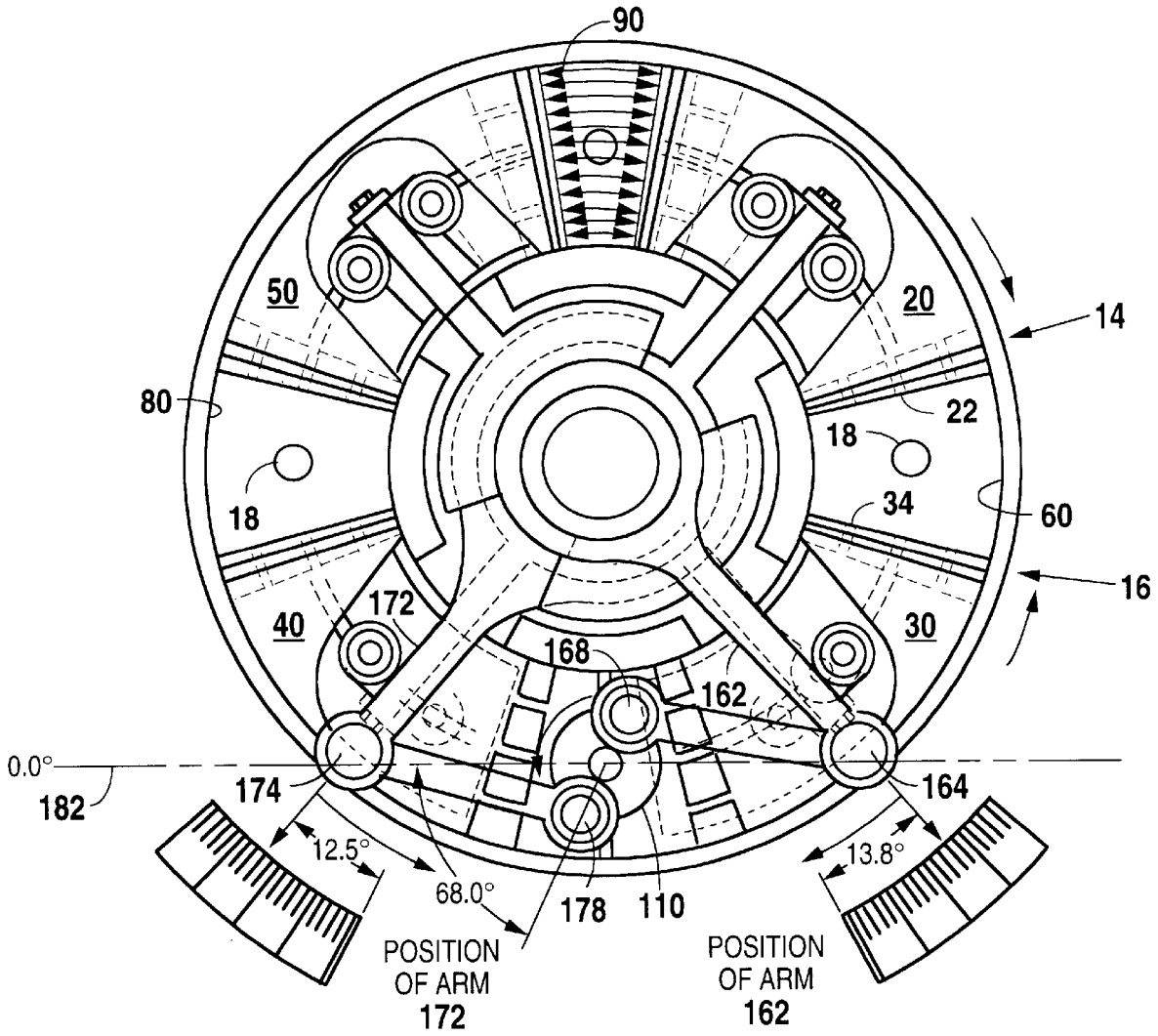
FIG. 12 is a schematic diagram showing the relative position of the two pairs of pistons disposed in a cylinder of the engine embodying the present invention, when the crankshaft is at a 68° counterclockwise rotation position.

At 60° of counterclockwise rotation of the crankshaft 110, as shown in FIG. 10, the exhaust port 16 is closed by the head 34, thus ending scavenging of the cylinder 60. Immediately after the head 34 closes the exhaust port 16, supercharging and the introduction of fuel, either directly or indirectly, with or without supplemental air injection may take place since the intake port 14 remains open until 68° of rotation, as shown in FIG. 12, at which point the intake port 14 is closed by the head 22. Desirably, fuel can be introduced directly into the cylinder 60, by a fuel injector 19 disposed in or near the intake port 22. The respective closing of the exhaust and inlet ports respectively at 60° and 68°, is indicated on the graph of FIG. 8.

When the intake port 14 is closed, compression of the trapped volume begins and continues until the spark of the sparkplug 18, or alternatively in a diesel engine autoignition due to the heat of compression, ignites the combustible mixture at a point near the beginning of the almost constant volume (ACV) at 162° of counter-clockwise rotation of the crankshaft 110. The actual ignition timing can be adjusted as is commonly known to compensate for changes in fuel octane or cetane ratings, altitude, temperature, or other variable parameters affecting combustion.

Figure 13:
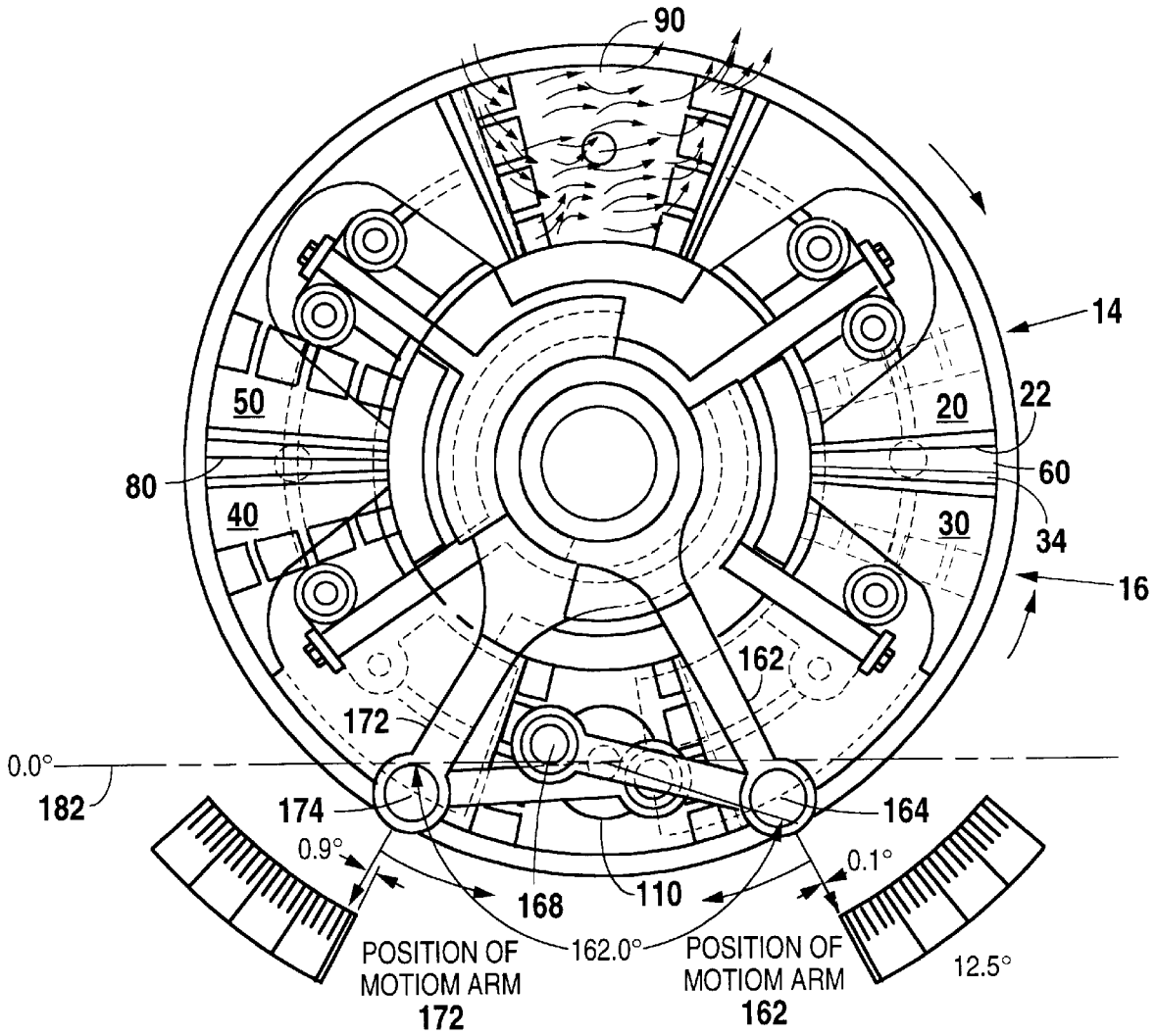
FIG. 13 is a schematic diagram showing the relative position of the two pairs of pistons disposed in a cylinder of the engine embodying the present invention, when the crankshaft is at a 162° counterclockwise rotation position.
Figure 14:
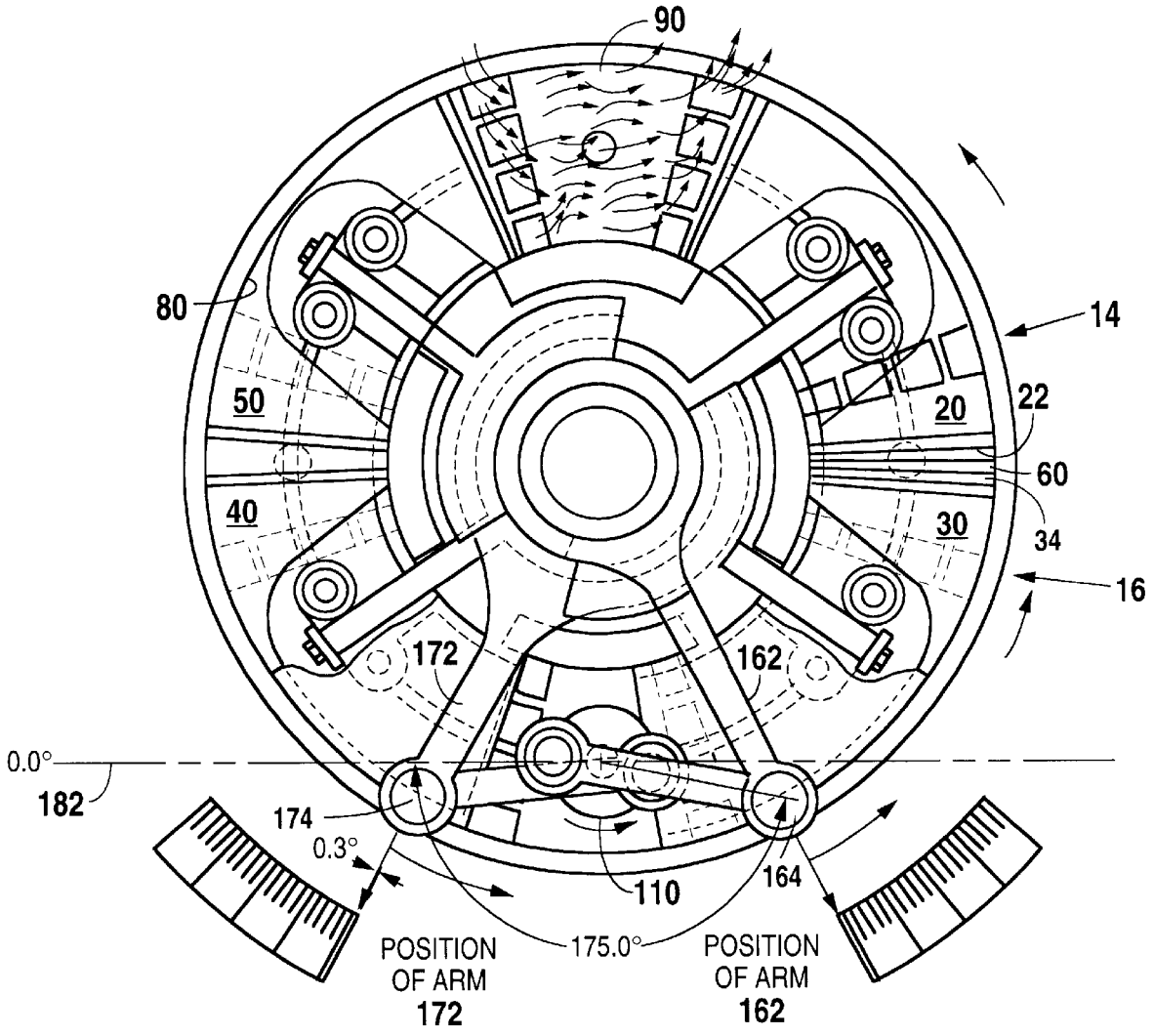
FIG. 14 is a schematic diagram showing the relative position of the two pairs of pistons disposed in a cylinder of the engine embodying the present invention, when the crankshaft is at a 175° counterclockwise rotation position.
Figure 15:
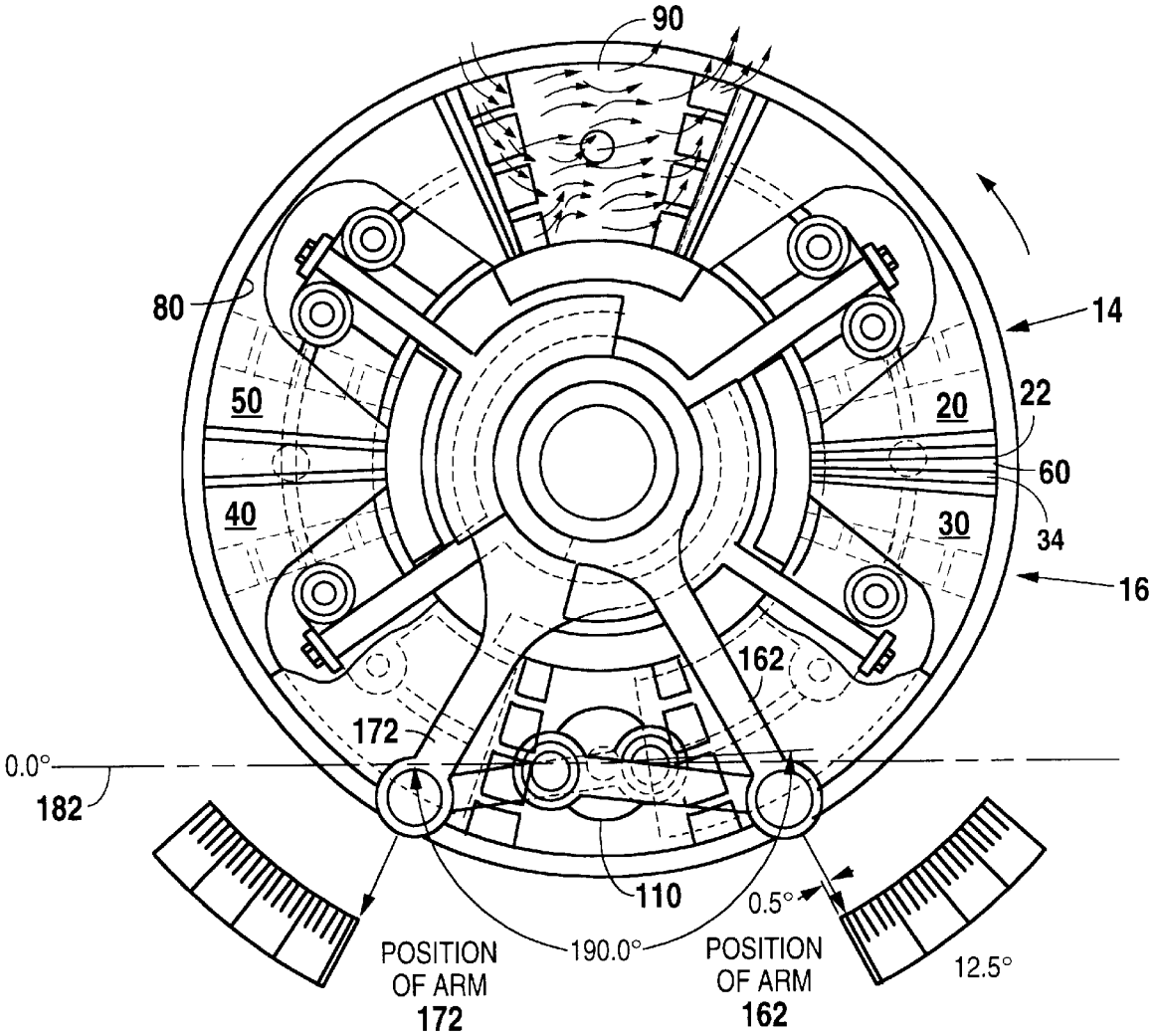
FIG. 15 is a schematic diagram showing the relative position of the two pairs of pistons disposed in a cylinder of the engine embodying the present invention, when the crankshaft is at a 190° counterclockwise rotation position.
Figure 16:
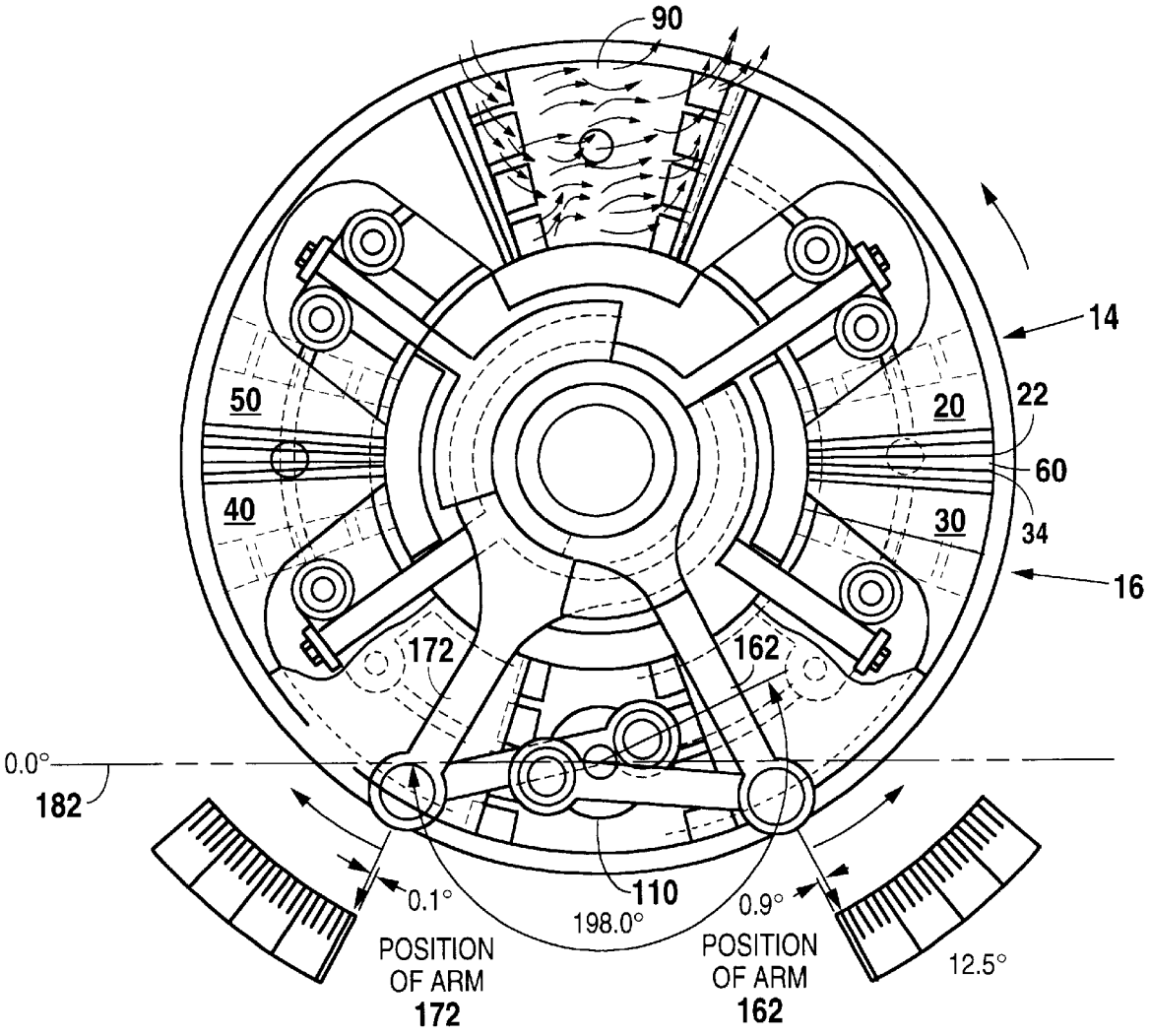
FIG. 16 is a schematic diagram showing the relative position of the two pairs of pistons disposed in a cylinder of the engine embodying the present invention, when the crankshaft is at a 198° counterclockwise rotation position.

As described above, the movement of the intake and exhaust heads 22, 34 maintain an almost constant arcuate separation distance between them from 162°, as shown in FIG. 13, to 198°, as shown in FIG. 16, thus keeping almost constant the volume of the moving combustion chamber 60 as the combustion process progresses. Importantly, the intake head 22, which had been traveling in a clockwise circular direction, opposite the counter-clockwise direction of the exhaust head 34, reaches its TDC position at 170°, and as shown at 175° in FIG. 14, has reversed its direction to counter-clockwise movement whereupon it is moving in the same direction of travel as the exhaust head 34. The exhaust head 34 reaches its TDC at 190°, as shown in FIG. 15, whereupon it reverses direction to a clockwise motion and begins to move away from the head 22. As described above, an almost constant volume is maintained in the moving combustion chamber 60 from 162° to 198° of crankshaft rotation. During the 36° (162° to 198°) angle of crankshaft rotation, a small separation varying less than 10, is continuously maintained between the opposed heads 22, 34 and an almost constant volume (ACV) is thereby maintained in the moving combustion chamber 60 during that period. This prolonged time allows the combustion process to better establish itself so that better combustion of the air-fuel mixture is achieved, resulting in a more advantageous and consistent rise of pressure in the cylinder 60, and reduction in combustion products because of the longer time in which combustion takes place at an almost constant volume. After the period of almost constant volume, the heads 22, 34 are moved in opposite directions. At 198°, as shown in FIG. 16, the intake and exhaust heads 22, 34 begin to move away from each other by a distance greater than 1° from their closest approach, ending the ACV condition in the cylinder 60 and beginning the expansion stroke of the two-cycle engine.

At 170° crankshaft rotation, the intake head 22 reaches its TDC and reverses direction of movement from clockwise to counter-clockwise. Thus, at 175°, as shown in FIG. 14, both heads 22, 34 are moving in the same counterclockwise direction, and continue their codirectional movement until the exhaust head 34 reaches its TDC at 190°, as shown in FIG. 15. After the exhaust head 34 reaches its TDC at 190°, it reverses direction and begins to move in a clockwise direction away from the direction of movement of the intake head 22.

Figure 8:
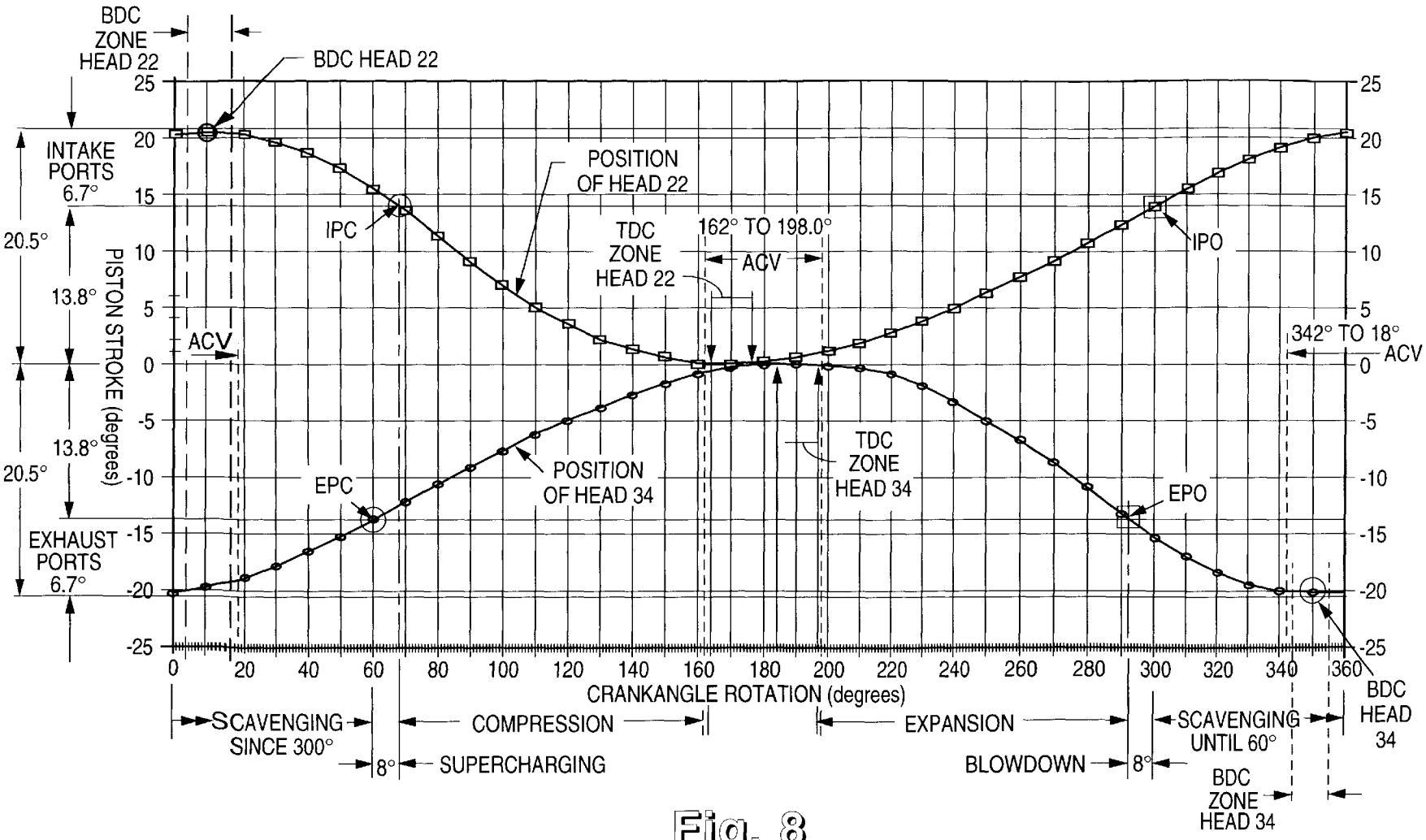
FIG. 8 is a graph showing the position of each head of a pair of opposed heads defining the moveable boundaries of a cylinder during one rotation of a crankshaft of the engine embodying the present invention.
Figure 17:
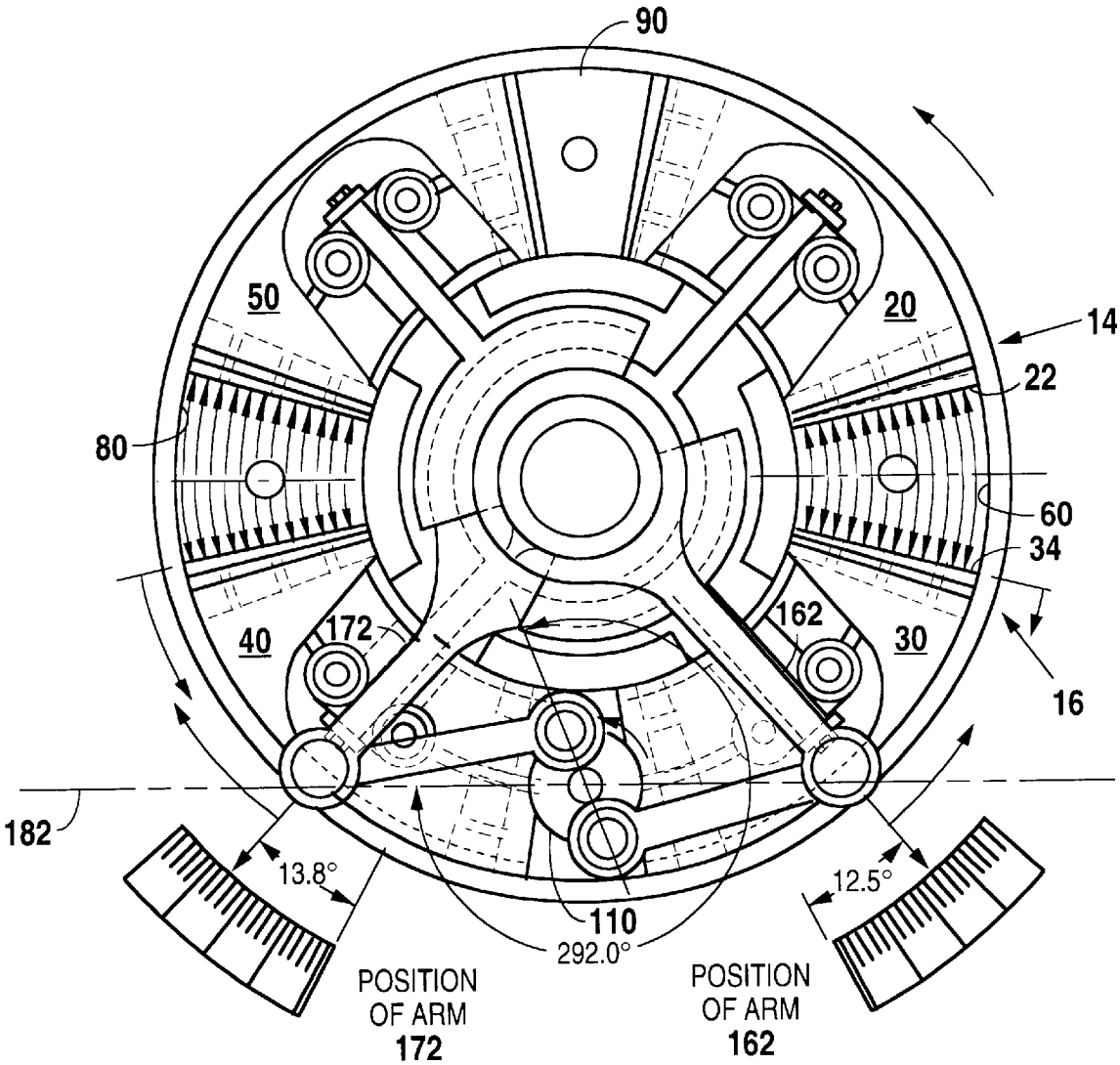
FIG. 17 is a schematic diagram showing the relative position of the two pairs of pistons disposed in a cylinder of the engine embodying the present invention, when the crankshaft is at a 292° counterclockwise rotation position.

The expansion stroke lasts until the exhaust port 16 begins to be uncovered by the exhaust head 34, at the 292° rotation angle as shown in FIG. 17 and on the graph of FIG. 8. At this point, the inlet port 14 is still closed and blow-own begins, that is, the release of the remaining pressure of the gases of combustion are released. Blow-down ends when the intake port 14 is uncovered by head 22 beginning at the 300° crankshaft rotation angle, as shown in FIG. 18 and indicated on the graph of FIG. 8.

Both heads, 22, 34 continue their travel in opposite directions and uniflow scavenging takes place between the open inlet port 14 and through the open exhaust port 16. As noted above, at 350°, as shown in FIG. 19, the head 34 attains its BDC position, whereupon it reverses its direction of travel. During 6° of crankshaft movement of each side of the respective BDC positions at 350° and 10°, each head 22, 34 respectively moves through an arc of less than about ±0.1°. From 342° to 18°, there is less than 1.0° arcuate movement between the heads 22, 34. Between the respective BDC positions (350° and 10°, both heads are moving in the same direction at a substantially constant separation distance, thus maintaining an almost constant maximum volume between about 342° and 18° rotation angles of the crankshaft 110. Importantly, uniflow scavenging of the cylinder 60 occurs during 120° of rotation of the crankshaft, i.e., from the 300° position at which the intake port 14 opens and the 60° position at which the exhaust port 16 closes. This feature is particularly advantageous since it greatly benefits scavenging.

Thus, the opposed heads 22, 34 are unidirectionally moveable when at a position proximate the respective top dead center positions whereby the volume of the moving combustion chamber 60 is maintained at a substantially constant minimum value and unidirectionally moveable between a position proximate their respective bottom dead center positions whereby the volume of the cylinder 60 is maintained at a substantially constant maximum value, for respective prolonged periods during each rotation of the crankshaft 110.

The differential travel rate of the heads 22, 34, with respect to each other, can easily be seen with reference to the graph shown in FIG. 8. The intake head 22 moves through an arc of 13.8° from its position at which it closes the inlet port 14 (68°) to its top dead center position (170°), during a 102° (170°–68°) rotation of the crankshaft 110. In comparison, the exhaust head 34 moves through a circular arc of 13.8°, between closure of its exhaust port 60° and its top dead center position (190°), during 130° (190°–60°) of rotation of the crankshaft 110. Thus, during the compression stroke, the intake head 22 moves through the same angular displacement as the exhaust head 34, but during a shorter rotation of the crankshaft 110. This is represented by the steeper slope of the line representing the movement of the intake head 22. Conversely, during the expansion, or power, stroke, the exhaust head 34 moves between its top dead center position 190° and the point at which the exhaust port is opened (292°), an arcuate movement of 13.8°, during 102° (292°–190°) rotation of the crankshaft 110, whereas the intake head 22 moves 13.8° between its top dead center position (170°) and the position at which the inlet port is opened (300°), during a 130° (300°–170°) rotation of the crankshaft 110. Thus, during the expansion stroke, the exhaust head 34 moves through the same angular displacement as the intake head 22, but during a shorter rotation of the crankshaft 110.

Therefore, during the compression stroke of the combustion cycle, the intake head 22 is moved at a rate faster than that of the exhaust head 34, and during the expansion stroke of the combustion cycle, the exhaust head 34 is moved at a rate faster than the intake head 22.

The method for operating the two-cycle internal combustion engine 10 embodying the present invention can be described beginning just prior to the 162° crankshaft angle rotation position whereat the almost constant minimum volume condition (less than about 1° change in arcuate separation of the opposed heads) in the chamber 60 begins. The method includes the steps of moving the intake head 22 to the beginning of its top dead center position at 170°, igniting the fuel-air mixture disposed between the heads 22, 34 when the heads are at a substantially minimum spaced apart distance, moving the intake head 22 away from its top dead center position, moving the exhaust head 34 to the beginning of its top dead center position at 190° and then moving the exhaust head 34 away from the top dead center position, and passing the exhaust head 34 past the exhaust port 16, thereby opening the exhaust port 16 while the exhaust head 34 is moving towards its bottom dead center position. Combustion products of the ignited fuel-air mixture are exhausted from the cylinder 60 upon opening of the exhaust port 16. Continuing on, the intake head 22 is then moved past the intake port 14, thereby opening the intake port 14, while moving the intake head 22 towards its respective bottom dead center position. The exhaust head 34 is moved to its bottom dead center position at 350°, after which it is moved away from the bottom dead center position toward its top dead center position. The intake head 22 is then moved to its bottom dead center position at 10° after which it reverses direction as it is moved toward the top dead center position. The exhaust head 34 is then moved past the exhaust port 16, thereby closing the exhaust port 16 while the exhaust head 34 moves toward its respective top dead center position. A combustible fuel-air mixture is introduced through the intake port 14 and into the cylinder 60, or alternatively a combustible fuel is added to air in the cylinder 60, either at atmospheric pressure, or at a pressure greater than that of the surrounding atmosphere, thereby advantageously supercharging the cylinder 60. The intake head 22 is then moved past the intake port 14, thereby closing the intake port 14. The mixture of combustible fuel and air is then compressed in the cylinder 60 as a result of moving the heads 22, 34 toward each other and to their respective top dead center positions. Desirably, the method also includes uniflow scavenging by directing a flow of air through the cylinder 60, between the open intake port 14 and the open exhaust port 16, and charging, or preferably supercharging, of the cylinder 60 during the period of time that the exhaust port 14 is opened and the exhaust port 16 is closed during the compression stroke. Preferably, although natural aspiration may be used, the scavenging is accomplished by a pressurized flow of air through the cylinder 60.

Figure 20:
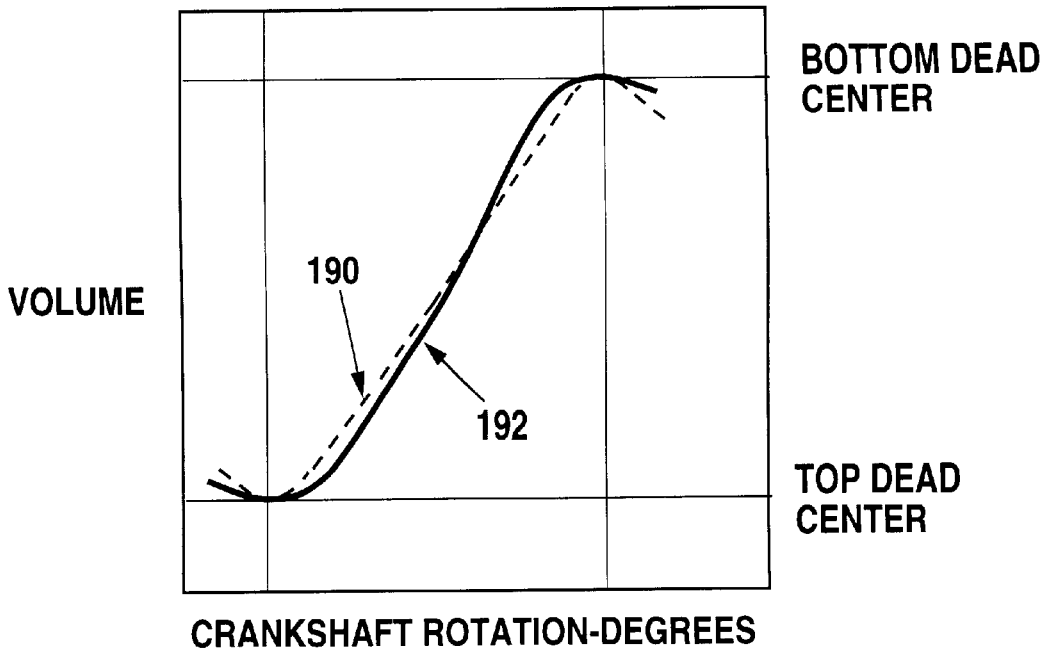
FIG. 20 is a graph illustrating the relationship between the cylinder volume and the crankshaft rotation angle for a conventional two-cycle engine and for the engine embodying the present invention.

The arrangement of the engine 10, embodying the present invention causes the volume between the opposed pistons to remain small, i.e., at a minimum almost constant value, for a much longer period of time, e.g., during about 36° of rotation of the crankshaft, than in a conventional engine. This relationship is illustrated in FIG. 20. The cylinder volume as a function of crankshaft rotation angle is indicated by the dashed line 190 for a conventional two-cycle engine and by the solid line 192 for the engine embodying the present invention.

Figure 21:
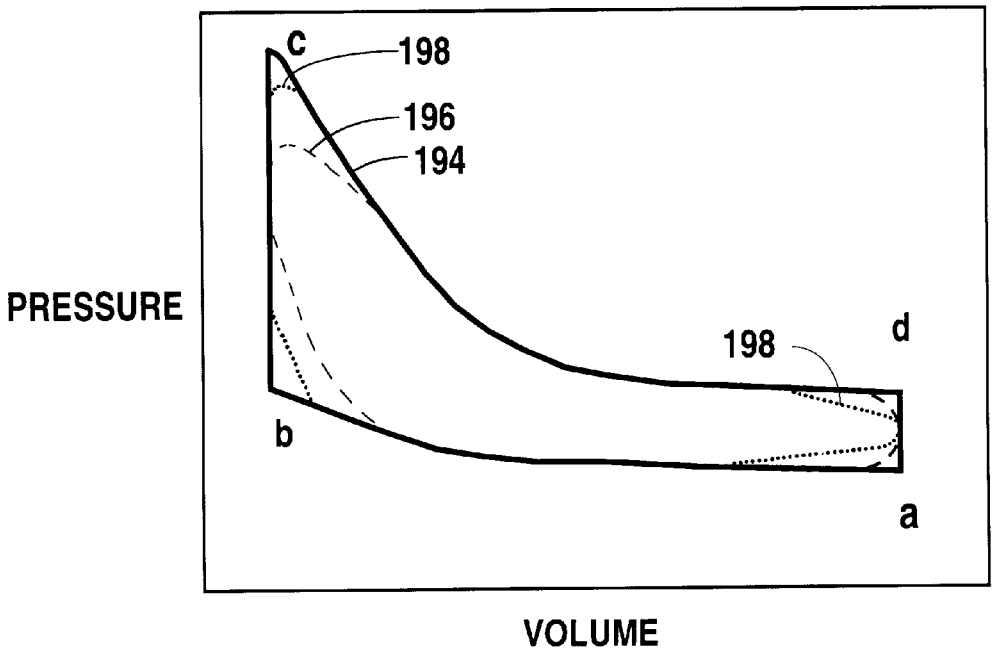
FIG. 21 is a graph showing the relationship between cylinder pressure and volume for an ideal cycle, for a conventional cycle, and for the cycle of the engine embodying the present invention.

In FIG. 21, a graphical representation of the pressure-volume relationship of an ideal Otto cycle, a cycle representative of a conventional two-stroke spark-ignited engine, and the cycle representative of the engine embodying the present invention is presented. In the pressure-volume diagram, compression occurs between points a and b, a combustion from b to c, expansion from c to d and exhaust from d to a. In the ideal cycle, represented by the solid line 194, it is assumed that combustion occurs instantly when the cylinder volume is at a minimum. It is also assumed that the intake and exhaust valves open and close instantly. This idea cycle is not possible in the real world, but it gives a way to compare the performance of real cycles because the ideal cycle represents the maximum possible work and efficiency. The work produced in each cycle is represented by the enclosed area defined by the boundary of each cycle. In the real cycles, represented by a dashed line 196 representative of a conventional engine cycle and the dotted line 198 representative of the cycle of the engine 10 embodying the present invention, combustion requires a significant period of time as does the opening and closing of the valve ports. Therefore, the conventional cycle 196 has rounded edges and encloses an area smaller than the area of the ideal cycle. Less work is produced by the conventional cycle even though the same amount of fuel is used so both power and economy are decreased.

However, in the engine embodying the present invention, the opposed heads dwell closer to each other for a much longer period of time so more of the combustion process occurs near the minimum volume value of the cylinder. As a result, the cycle of the engine embodying the present invention is closer to the ideal cycle. Similarly, at the maximum volume of the cylinder, there is more time for the exhaust process to occur and port opening and closing can be made nearer the maximum volume position of the opposed heads. This also brings the pressure-volume relationship of the engine embodying the present invention closer to that of the ideal cycle. Thus, because of the more advantageous operating characteristics, the engine 10 embodying the present invention has the potential for higher specific power output and better fuel economy than a conventional two-cycle engine.

There are two other important advantages of a combustion cycle that has a long dwell period at minimum volume. One of these is the potential for lower hydrocarbon emissions.

This advantage is described above with respect to the problem of unburned fuel next to the wall that leaves the engine in the exhaust stream. Secondly, emissions of nitrogen oxides (NOx) are produced by high gas temperatures. However, NOx reduction may be reduced by the use of leaner fuel-air ratios, since this reduces the combustion temperature. In addition, lean mixtures improve fuel economy. In all engines, there is a limit to the amount of reduction in fuel-air ratio that is possible. As the fuel-air ratio is reduced, the flame speed decreases and finally becomes so slow that the combustion process is not completed during the expansion stroke. The engine embodying the present invention is well-suited for the use of lean mixtures because of the relatively long time during which the volume of the cylinder is at a minimum, giving a longer period of time for combustion to occur. Hence, the engine embodying the present invention should be more tolerant of lean mixtures than the conventional engine, providing a way to reduce the emissions of NOx as well as improved fuel economy.

Although the present invention is described in terms of a preferred exemplary embodiment, with specific linkage relationships between the pistons and crankshaft and illustrative angular relationships between components, those skilled in the art will recognize that changes in those linkages, and angular relationships may be made without departing from the spirit of the invention. For example, other angular offset angles, of the intermediate pivot joints 168, 178 with respect to the 0° angle reference position of the crankshaft 110, such as 5° or 15°, may be employed. Reduction of the angular offset will result in a shorter almost constant volume relationship between the respective TDC and BDC positions of the opposed heads. Increasing the angular offset will extend the length of the respective almost constant volume relationships. Also, if more than four cylinders are desired in the engine, a second or even a third toroidal structure may be easily provided in series with the toroidal structure described and illustrated above. Such changes are intended to fall within the scope of the following claims. Other aspects, features, and advantages of the present invention may be obtained from a study of this disclosure and the drawings, along with the appended claims.

What we claim is:

1. A two-cycle internal combustion engine, comprising:

a hollow toroidal structure having an interior surface in which a plurality of intake ports and exhaust ports are defined at predefined spaced apart positions along said interior surface, said hollow toroidal structure being disposed about a central axis;

a first pair of toric segment-shaped pistons oscillatably disposed in said hollow toroidal structure at radially opposed spaced apart positions, each member of said first pair of pistons having an exhaust port controlling head and an intake port controlling head, said intake port controlling head being spaced from said exhaust port controlling head;

a second pair of toric segment-shaped pistons oscillatably disposed in said hollow toroidal structure at radially opposed spaced apart positions in interposed relationship with said first pair of pistons, each member of said second pair of pistons having an exhaust port controlling head and an intake port controlling head, said intake port controlling head being spaced from said exhaust port controlling head;

said first and second pairs of pistons being arranged in said hollow toroidal structure so that the exhaust port controlling head of each of said first pair of pistons is disposed in opposed relationship with the intake port controlling head of one of said second pair of pistons, and the intake port controlling head of each of said first pair of pistons is disposed in opposed relationship with the exhaust port controlling head of one of said second pair of pistons thereby forming four pairs of opposed heads that cooperate with preselected portions of said interior surface of the hollow toroidal structure to define respective variable volume cylinders each having at least one of said intake ports and at least one of said exhaust ports in fluid communication therewith and a volume which is increased by the movement of said opposed heads away from each other during an expansion stroke and is decreased by the movement of said opposed heads toward each other during a compression stroke, said intake port controlling head respectively defining a portion of each of said variable cylinders operatively opening and closing said intake port in fluid communication with said respective cylinder, and said exhaust port controlling head respectively defining a portion of each of said cylinders operatively opening and closing said exhaust port in fluid communication with said respective cylinder; and the oscillatory movement of each of said first and second pairs of pistons being controlled so that the exhaust port disposed in each of the respective cylinders is opened before opening of the intake port during an expansion stroke and said exhaust port is closed before closure of the intake port during a compression stroke, each of said intake port controlling heads is disposed at its top dead center position before the opposed one of said exhaust port controlling heads is disposed at its top dead center position during a compression stroke, and said intake port controlling heads are moved at a rate faster than that of the exhaust port controlling heads during a compression stroke and at a rate slower than that of the exhaust port controlling heads during an expansion stroke.

2. A two-cycle internal combustion engine, as set forth in claim 1, wherein said engine includes at least one air compressor in fluid communication with said plurality of intake ports whereby said cylinders are supercharged during respective compression strokes after closure of a respective exhaust port and prior to closure of a respective intake port.

3. A two-cycle internal combustion engine, as set forth in claim 1, wherein each piston of said first and second pairs of toric segment-shaped pistons has a mid portion disposed between the intake port controlling and exhaust port controlling heads of the respective pistons and is operatively connected at said mid portion to a crankshaft.

4. A two-cycle internal combustion engine, as set forth in claim 3, wherein said engine includes:

an auxiliary shaft concentrically disposed along said central axis of the hollow toroidal structure;

a first hollow shaft oscillatably mounted in concentric relationship with said auxiliary shaft;

a second hollow shaft oscillatably mounted in concentric relationship with said first hollow shaft;

a first pair of rods respectively connecting the mid portion of each one of said first pair of pistons to said first hollow shaft;

a second pair of rods respectively connecting the mid portion of each one of said second pair of pistons to said second hollow shaft;

a crankshaft having a single direction of rotation and disposed in spaced relationship from said auxiliary shaft;

a first articulated linkage extending between said first hollow shaft and said crankshaft; and a second articulated linkage extending between said second hollow shaft and said crankshaft.

5. A two-cycle internal combustion engine, comprising:

a hollow toroidal structure having an interior surface in which a plurality of intake ports and exhaust ports are defined at predefined spaced apart positions along said interior surface, said hollow toroidal structure being disposed about a central axis;

a first pair of toric segment-shaped pistons oscillatably disposed in said hollow toroidal structure at radially opposed spaced apart positions, each member of said first pair of pistons having an exhaust port controlling head and an intake port controlling head, said intake port controlling head being spaced from said exhaust port controlling head;

a second pair of toric segment-shaped pistons oscillatably disposed in said hollow toroidal structure at radially opposed spaced apart positions in interposed relationship with said first pair of pistons, each member of said second pair of pistons having an exhaust port controlling head, an intake port controlling head, said intake port controlling head being spaced from said exhaust port controlling head;

a crankshaft operatively connected to said first and second pair of pistons; and said first and second pairs of pistons being arranged in said hollow toroidal structure so that the intake port controlling head of each of said first pair of pistons is disposed in opposed relationship with the exhaust port controlling head of one of said second pair of pistons, and the intake port controlling head of each of said second pair of pistons is disposed in opposed relationship with the exhaust port controlling head of one of said first pair of pistons thereby forming four pairs of opposed heads that cooperate with preselected portions of said interior surface of the hollow toroidal structure to define four variable volume cylinders in which the volume is increased by the movement of the opposed heads in respective opposite directions away from each other during an expansion stroke and is decreased by the movement of said opposed heads in respective opposite directions toward each other during a compression stroke with one compression stroke, one combustion event, one expansion stroke and one scavenging event occurring during one 360 degree rotation of said crankshaft, each of the opposed heads of each cylinder being individually moveable between a respective top dead center and a respective bottom dead center position within said cylinder, and both of said opposed heads of said defined cylinder being unidirectionally movable when at a position proximate their respective top dead center positions whereby the volume of said cylinder is maintained at a substantially constant minimum value for a prolonged period during each rotation of said crankshaft, and at a position proximate their respective bottom dead center positions whereby the volume of said cylinder is maintained at a substantially constant value for a prolonged period during each rotation of said crankshaft, said opposed heads having a constantly varying phase angle relationship with respect to each other whereby said intake port controlling head is disposed at its top dead center position before the exhaust port controlling head is disposed at its top dead center position and the exhaust port controlling head is disposed at its bottom dead center position before the intake port controlling head is disposed at its bottom dead center position during each rotation of the crankshaft.

6. A two-cycle internal combustion engine, comprising:

a hollow toroidal structure having an interior surface in which a plurality of intake ports and exhaust ports are defined at predefined spaced apart positions along said interior surface, said hollow toroidal structure being disposed about a central axis;

a first pair of toric segment-shaped pistons oscillatably disposed in said hollow toroidal structure at radially opposed spaced apart positions, each member of said first pair of pistons having an exhaust port controlling head and an intake port controlling head, said intake port controlling head being spaced from said exhaust port controlling head;

a second pair of toric segment-shaped pistons oscillatably disposed in said hollow toroidal structure at radially opposed spaced apart positions in interposed relationship with said first pair of pistons, each member of said second pair of pistons having an exhaust port controlling head and an intake port controlling head, said intake port controlling head being spaced from said exhaust port controlling head;

said first and second pairs of pistons being arranged in said hollow toroidal structure so that the exhaust port controlling head of each of said first pair of pistons is disposed in opposed relationship with the intake port controlling head of one of said second pair of pistons, and the intake port controlling head of each of said first pair of pistons is disposed in opposed relationship with the exhaust port controlling head of one of said second pair of pistons thereby forming four pairs of opposed heads that cooperate with preselected portions of said interior surface of the hollow toroidal structure to define respective cylinders each having one of said intake ports and one of said exhaust ports in fluid communication therewith and a variable volume which is increased by the movement of said opposed heads away from each other during an expansion stroke of a combustion cycle and is decreased by the movement of said opposed heads toward each other during a compression stroke of said combustion cycle, a predefined one of said opposed heads respectively defining a portion of each of said variable cylinders operatively opening and closing said intake port in fluid communication with said respective cylinder and the other one of said opposed heads operatively opening and closing said exhaust port in fluid communication with said respective cylinder wherein said head operatively opening and closing said intake port is moved with respect to the interior surface of said hollow toroidal structure at a rate faster than said head operatively opening and closing said exhaust port during the compression stroke of said combustion cycle, and said head operatively opening and closing the exhaust port is moved with respect to the interior surface of said hollow toroidal structure at a rate faster than said head operatively opening and closing said intake port during the expansion stroke of said combustion cycle, each of said exhaust port controlling heads being disposed at its respective bottom dead center position prior to the opposed one of said intake port controlling heads being disposed at its bottom dead center position and each of said intake port controlling heads being disposed at its respective top dead center position prior to the opposed one of said exhaust port controlling heads being disposed at its respective top dead center position during each combustion cycle.

7. A two-cycle internal combustion engine, as set forth in claim 6, wherein each member of each of said first and second pairs of pistons has a mid portion disposed intermediate the respective intake port controlling and exhaust port controlling heads of the pistons, and said engine includes:

an auxiliary shaft concentrically disposed along said central axis of the hollow toroidal structure;

a first hollow shaft oscillatably mounted in concentric relationship with said auxiliary shaft;

a second hollow shaft oscillatably mounted in concentric relationship with said first hollow shaft;

a first pair of rods respectively connecting the mid portion of each one of said first pair of pistons to said first hollow shaft;

a second pair of rods respectively connecting the mid portion of each one of said second pair of pistons to said second hollow shaft;

a crankshaft having a single direction of rotation and disposed in spaced relationship from said auxiliary shaft;

a first articulated linkage extending between said first hollow shaft and said crankshaft; and a second articulated linkage extending between said second hollow shaft and said crankshaft.

8. A method for operating a two-cycle internal combustion engine having at least one variable volume cylinder with an intake port and an exhaust port in fluid communication therewith and in which a intake port controlling head and an exhaust port controlling head are oscillatably disposed for movement toward and away from each other and between respective separate top dead center and bottom dead center positions equidistantly spaced from a defined center of said cylinder, said method comprising:

moving said intake port controlling head toward the top dead center position of said intake port controlling head;

moving said exhaust port controlling head toward the top dead center position of the exhaust port controlling head, said intake port controlling and said exhaust port controlling heads being at a substantially minimum spaced apart distance whereat a substantially minimum volume of the cylinder is formed;

igniting a fuel-air mixture disposed between said intake port controlling head and said exhaust port controlling head;

moving said intake port controlling head to the top dead center position of said intake port controlling head;

moving said intake port controlling head away from the top dead center position of the intake port controlling head and toward the bottom dead center position of said intake port controlling head;

subsequently moving said exhaust port controlling head to the top dead center position of the exhaust port controlling head;

moving said exhaust port controlling head away from the top dead center position of the exhaust port controlling head and toward the bottom dead center position of said exhaust port controlling head;

passing said exhaust port controlling head past said exhaust port and thereby opening said exhaust port while said exhaust port controlling head is moving toward the respective bottom dead center position and exhausting products of the ignited fuel-air mixture from said cylinder;

passing said intake port controlling head past said intake port and thereby opening said intake port while moving said intake port controlling head toward the bottom dead center position;

moving said exhaust port controlling head to the bottom dead center position of said exhaust port controlling head;

moving said exhaust port controlling head away from the respective bottom dead center position and toward the top dead center position of said exhaust port controlling head;

subsequently moving said intake port controlling head to the bottom dead center position of said intake port controlling head;

moving said intake port controlling head away from the respective bottom dead center position and toward the top dead center position of said intake port controlling head;

passing said exhaust port controlling head past said exhaust port and thereby closing said exhaust port while moving said exhaust port controlling head toward the respective top dead center position;

injecting a combustible fuel into said cylinder;

passing said intake port controlling head past said intake port and thereby closing said intake port while moving said intake port controlling head toward the top dead center position of said intake port controlling head; and compressing a mixture of combustible fuel and air in said cylinder while moving said intake port controlling head and said exhaust port controlling head toward their respective top dead center positions.

9. A method for operating a two-cycle internal combustion engine, as set forth in claim 8, wherein after passing said intake port controlling head past said intake port and thereby opening said intake port while moving said intake port controlling head toward the bottom dead center position and before moving said exhaust port controlling head to the bottom dead center position of said exhaust port controlling piston, said method includes directing a flow of air through said cylinder between said open intake port and said open exhaust port.

10. A method for operating a two-cycle internal combustion engine, as set forth in claim 9, wherein said directing a flow of air through said cylinder between said open intake port and said open exhaust port includes directing a flow of air having a pressure greater than the pressure of the surrounding atmosphere through said cylinder.

11. A method for operating a two-cycle internal combustion engine, as set forth in claim 8, wherein said injecting a combustible fuel into said cylinder includes injecting a mixture of combustible fuel and air through said intake port and into said cylinder.

12. A method for operating a two-cycle internal combustion engine, as set forth in claim 11, wherein said mixture of combustible fuel and air injected through said intake port is injected at a pressure greater than the pressure of the surrounding atmosphere.

13. A method for operating a two-cycle internal combustion engine, as set forth in claim 8, wherein said moving said intake port controlling head toward the top dead center position of said intake port controlling head includes moving said intake port controlling head at a faster rate of speed than the concurrent rate of speed of the exhaust port controlling head.

14. A method for operating a two-cycle internal combustion engine as set forth in claim 8, wherein said moving said exhaust port controlling head away from the top dead center position of the exhaust port controlling head and toward the bottom dead center position of said exhaust port controlling head includes moving said exhaust port controlling head at a faster rate of speed than the concurrent rate of speed of the intake port controlling head at a greater rate of speed than that of the intake port controlling head.

* * * * *